US006733325B2

(12) United States Patent
Sakai et al.

(10) Patent No.: US 6,733,325 B2
(45) Date of Patent: May 11, 2004

(54) CONNECTOR ASSEMBLY FOR A FLAT WIRE MEMBER

(75) Inventors: Yoshito Sakai, Nagoya (JP); Hiroki Hirai, Nagoya (JP); Kenji Okamura, Nagoya (JP); Tomoyuki Sakata, Nagoya (JP)

(73) Assignees: Autonetworks Technologies, Ltd., Mie (JP); Sumitomo Wiring Systems, Inc., Mie (JP); Sumitomo Electric Industries, Ltd., Osaka (JP)

( * ) Notice: Subject to any disclaimer, the term of this patent is extended or adjusted under 35 U.S.C. 154(b) by 8 days.

(21) Appl. No.: 10/040,386

(22) Filed: Jan. 9, 2002

(65) Prior Publication Data

US 2002/0094717 A1 Jul. 18, 2002

(30) Foreign Application Priority Data

Jan. 12, 2001 (JP) ..... 2001-004940
Dec. 3, 2001 (JP) ..... 2001-369113

(51) Int. Cl.[7] ..... H01R 5/07
(52) U.S. Cl. ..... 439/495; 439/493
(58) Field of Search ..... 439/495, 496, 439/499, 490, 67, 176, 326, 492, 493, 631, 632, 374, 357, 347, 348

(56) References Cited

U.S. PATENT DOCUMENTS 4,802,866 A * 2/1989 Balzano et al. ..... 439/496
4,898,543 A * 2/1990 Benze ..... 439/374
4,907,975 A * 3/1990 Dranchak et al. ..... 439/67
4,996,478 A * 2/1991 Pope ..... 324/158
5,403,202 A * 4/1995 Roehling ..... 439/493
5,816,845 A * 10/1998 Chishima et al. ..... 439/495
5,906,504 A * 5/1999 Igarashi et al. ..... 439/495
5,920,465 A * 7/1999 Tanaka
6,004,139 A * 12/1999 Dramstad et al. ..... 439/59
6,165,007 A * 12/2000 Higuchi et al. ..... 439/492
6,224,407 B1 * 5/2001 Duquerroy et al. ..... 439/188
6,270,371 B1 * 8/2001 Doushita ..... 439/376
6,280,228 B1 * 8/2001 Maciejewski et al. ..... 439/374
6,520,797 B2 * 2/2003 Okamura et al. ..... 439/495

FOREIGN PATENT DOCUMENTS

JP A 11-329619 11/1999
JP A 11-329620 11/1999

* cited by examiner

*Primary Examiner*—Gary Paumen
*Assistant Examiner*—Phuongchi Nguyen
(74) *Attorney, Agent, or Firm*—Oliff & Berridge, PLC

(57) ABSTRACT

A connector assembly is provided with a connector (first connector) to be mounted on a circuit board and a connector (second connector) for holding a flat cable flat wire member). When the two connectors are connected with each other, an end portion of the cable is inserted into the connector to bring conductors of the cable into contact with mating terminals. The connector is provided with a plate-shaped holder, and the cable is supported on this holder in such a state as to be displaceable in widthwise direction. On the other hand, the connector is provided with a pair of locking pieces as a positioning portion. When the two connectors are connected with each other, the respective locking pieces directly come into contact with the cable being inserted into the connector from widthwise outer sides, thereby positioning the cable with respect to the connector in widthwise direction. The respective conductors of the flat wire member can be more precisely and securely brought into contact with the mating terminals.

19 Claims, 18 Drawing Sheets

CONNECTOR ASSEMBLY FOR A FLAT WIRE MEMBER

BACKGROUND OF THE INVENTION

This invention relates to a connector assembly for electrically connecting a flat cable, a ribbon wire, a FPC (flexible printed circuit) or like flat wire member, in which flat rectangular conductors are arrayed side by side, with a circuit board or the like.

There has been generally known a connector assembly for a flat wire member which assembly is comprised of a connector for circuit board (first connector) which accommodates a plurality of terminals side by side and is to be mounted on a circuit board, and a mating connector (second connector) to be mounted on an end portion of a flat wire member such as a flat cable, the flat wire member being connected with the circuit board by connecting the two connectors.

In such a connector assembly, the flat wire member has its end portion processed to expose conductors to outside, and this end portion is supported on a plate-shaped supporting member provided in the second connector. When the two connectors are connected, the end portion of the flat wire member is inserted together with the supporting member into the connector for circuit board to bring the respective conductors into contact with the terminals. As a result, the respective conductors of the flat wire member and patterns on the circuit board are electrically connected.

In the above conventional connector assembly, ribs are generally formed at the opposite widthwise ends (opposite ends with respect to a direction normal to an inserting direction into the first connector) of the supporting member, and the flat wire member is positioned with respect to the supporting member in widthwise direction by being restricted by means of these ribs. When the two connectors are connected with the supporting member positioned with respect to the first connector in widthwise direction, the respective conductors of the flat wire member are positioned with respect to the mating terminals.

However, such a construction in which the respective conductors of the flat wire member are indirectly positioned with respect to the mating terminals via the supporting member has the following problem. Specifically, even if the supporting member itself is properly positioned with respect to the first connector, contact positions of the conductors and the mating terminals are displaced in widthwise direction unless the flat wire member is properly positioned since there are errors in the positions and shape of the ribs of the supporting member. Such a displacement does not present any problem if contact areas of the conductors with the terminals are large in widthwise direction such as a case where the conductors are wide. However, if the contact areas are small, the conductors and the mating terminals may not be brought into contact with each other or the terminals may be shorted with different or noncorresponding conductors.

Accordingly, it is necessary to enable the respective conductors of the flat wire member and the mating terminals to be more precisely positioned. Particularly in recent years, there has been a demand to arrange the conductors and the terminals at a high density (at narrow intervals) in the connector assemblies for a flat wire member. The conductors and the mating terminals need to be highly precisely positioned in such connector assemblies.

SUMMARY OF THE INVENTION

It is an object of the present invention to provide a connector assembly which is free from the problems residing in the prior art.

It is another object of the present invention to provide a connector assembly which enables conductors of a flat wire member to be more precisely and securely brought into contact with mating terminals.

According to an aspect of the present invention, a connector assembly for a flat wire member comprises: a first connector for accommodating terminals, the first connector being provided with a positioning portion; and a second connector for holding a flat wire member, the second connector including a supporting member supporting a leading end portion of the flat wire member in such a way as to be movable in a widthwise direction which is normal to an inserting direction of the flat wire member into the first connector. The flat wire member is positioned with respect to the first connector in the widthwise direction by directly coming into contact with the positioning portion of the first connector.

These and other objects, features and advantages of the present invention will become more apparent upon a reading of the following detailed description and accompanying drawings.

BRIEF DESCRIPTION OF THE DRAWINGS

FIGS. 17A and 17B are sectional views showing the constructions of the cable connector and a board-side connector connected with the cable connector, wherein FIG. 17A shows a state before connection of the connectors and FIG. 17B shows a connected state of the connectors;

DETAILED DESCRIPTION OF THE PREFERRED EMBODIMENTS OF THE PRESENT INVENTION

Figure 1:
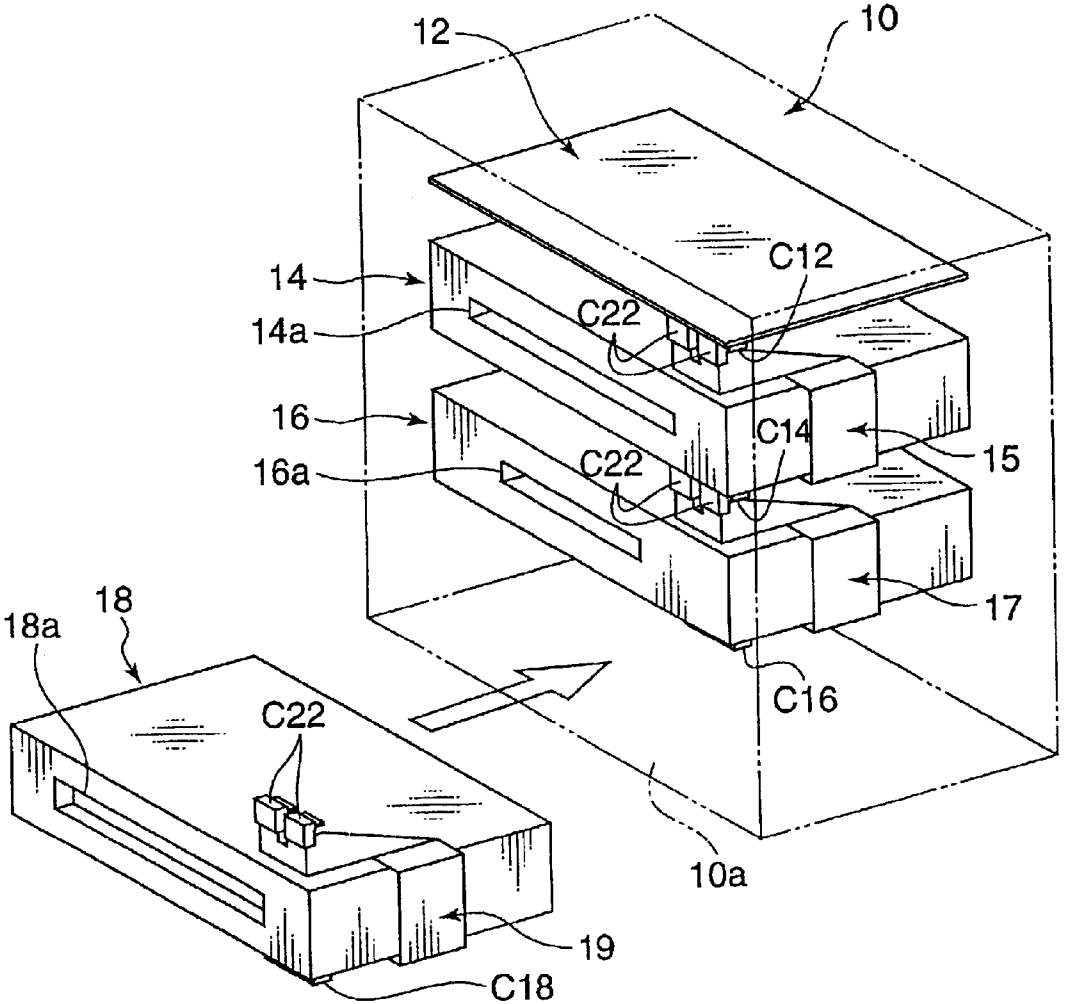
FIG. 1 is a perspective view showing an audio unit to be installed in an automotive vehicle which is applied with a connector assembly for a flat wire member according to an embodiment of the invention, including a casing.

Referring to FIG. 1 schematically showing an audio unit to be installed in an automotive vehicle, identified by 10 is a casing having openings at its front and rear sides, and a main circuit board 12 for centrally controlling this unit, a CD player 14, a MD (mini-disc) player and a CS (cassette) player 18 are accommodated and fixed in this order from above inside this casing 10.

The respective players 14, 16, 18 have insertion openings 14*a*, 16*a*, 18*a* for corresponding media, and are accommodated in the casing 10 such that these insertion openings 14*a*, 16*a*, 18*a* face a front opening 10*a* of the casing 10. These players 14, 16, 18 are assembled in a passenger's compartment with the insertion openings 14*a*, 16*a*, 18*a* thereof faced toward the passenger's compartment by mounting the casing 10 on an instrument panel from behind. Thus, the media can be inserted and taken out in the passenger's compartment. Though not shown, a panel (execution panel) provided with operable members for operating the respective players 14, 16, 18 is mounted on the front side of the casing 10.

The respective players 14, 16, 18 are provided with flat wire members 15, 17, 19 for electrical connection (flat cables in this embodiment: hereinafter referred to as cables 15, 17, 19) and connectors C14, C16, C18 (first connectors). By connecting the cables 15, 17, 19 of the players 14, 16, 18 with the connectors C12, C14, C16 of the main circuit board 12 or the players 14, 16, 18 located vertically adjacent with the main circuit board 12 and the players 14, 16, 18 accommodated while being vertically arranged as described above, the players 14, 16, 18 are electrically connected in a chain with the main circuit board 12.

The respective connectors C14, C16, C18 of the players 14, 16, 18 and the respective cables 15, 17, 19 have the same construction, so that, even if the players 14, 16, 18 are rearranged or any of them is omitted, they are connectable with each other. Hereinafter, these constructions are described, taking the CD player 14 as an example.

Figure 2:
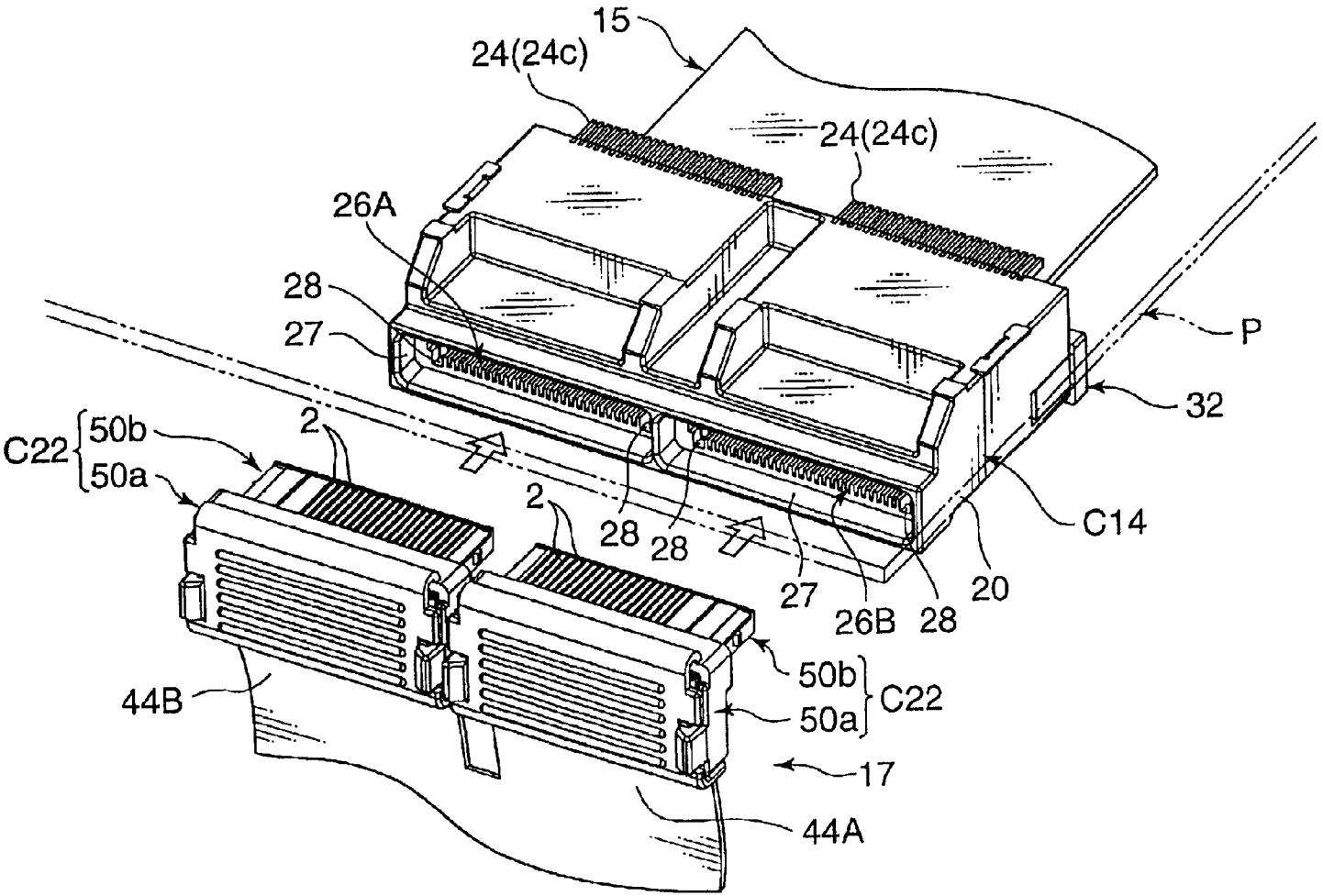
FIG. 2 is a perspective view showing a first connector to be mounted on a circuit board of a CD player and a second connector of a flat cable to be connected with the first connector.
Figure 3:
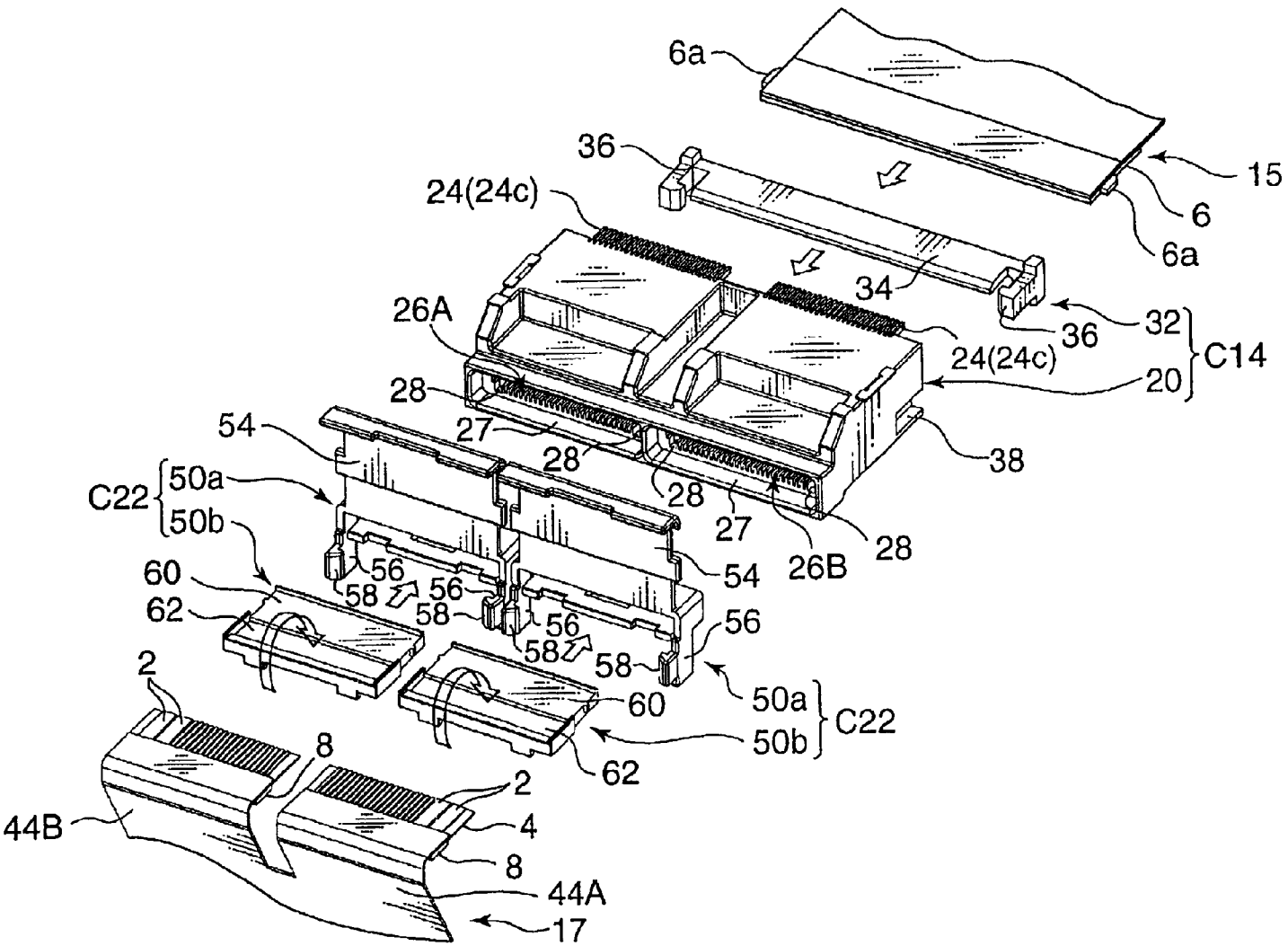
FIG. 3 is an exploded perspective view showing the first and second connectors.
Figure 4A:
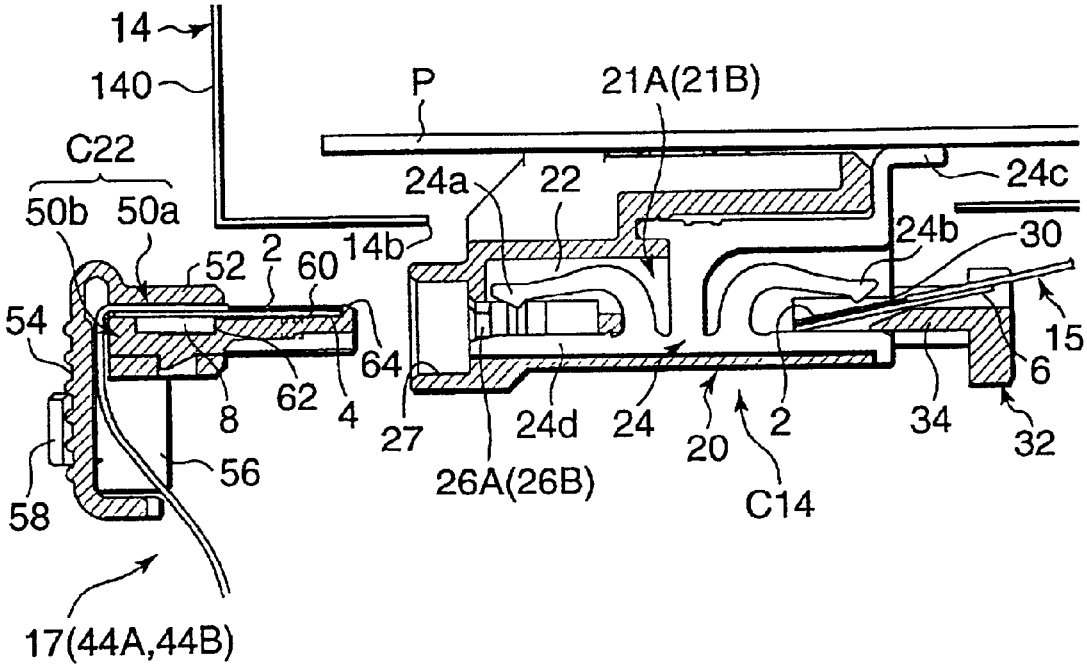
FIGS. 4A and 4B are sectional views showing constructions of the first and second connectors prior to and at an intermediate stage of connection of the two connectors, respectively.

As shown in FIGS. 2, 3 and 4A, the CD player 14 has a circuit board P inside its casing 140 (see FIG. 4A), and the connector C14 is provided on the lower surface of the circuit board P. The connector C14 is a connector for circuit board, is secured to the circuit board P by being mounted and is exposed to outside at the bottom side of the CD player 14 via an opening 14*b* formed in the casing 140.

The connector C14 is formed at its front side (left side in FIG. 4A) with a section to be connected with the cable 17 of the MD player 16, and the cable 15 of the CD player 14 is fixedly inserted at its rear side.

Figure 6:
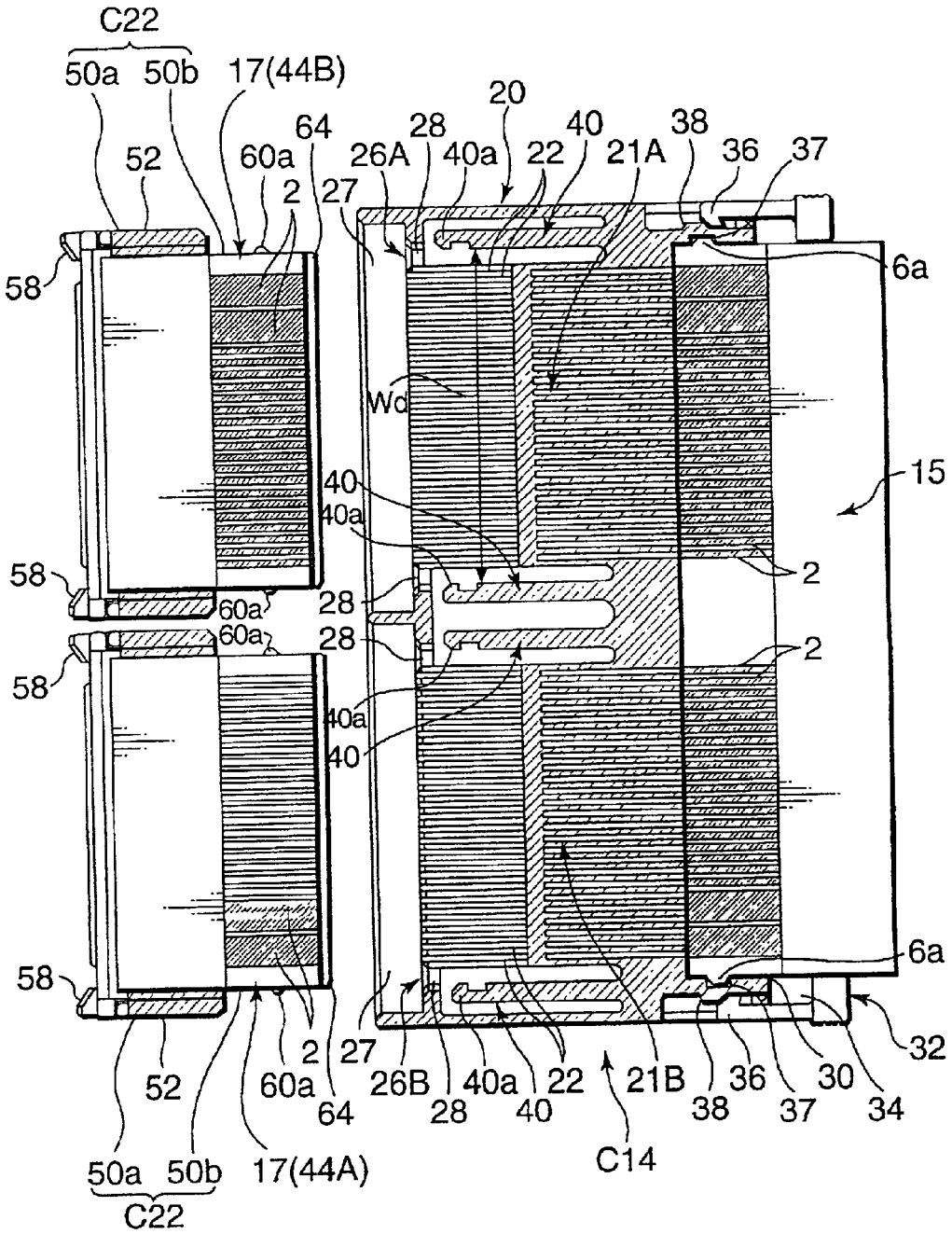
FIG. 6 is a sectional view showing constructions of the first and second connectors.

More specifically, the connector C14 has a female housing 20 narrow in the widthwise direction of the CD player 14 (direction normal to the plane of FIG. 4A: hereinafter referred to merely as widthwise direction). This housing 20 is formed with two connection sections 21A, 21B separated along the widthwise direction (vertical direction in FIG. 6) as shown in FIG. 6.

A plurality of cavities 22 are formed side by side along the widthwise direction in each connection section 21A, 21B, and terminals 24 (see FIG. 4A; not shown in FIG. 6) are accommodated in the respective cavities 22. As shown in FIG: 4A, each terminal 24 is comprised of a bottom portion 24*d* extending in forward and backward directions along the bottom of the cavity 22, resiliently deformable pieces 24*a*, 24*b* for connection which extend forward and backward from a middle portion of the bottom portion 24*d* and are vertically resiliently displaceable, and a leg portion 24*c* extending obliquely upward to the back from the middle between the resiliently deformable pieces 24*a* 24*b*. Each terminal 24 is electrically connected with a circuit on the circuit board by the leg portion 24*c* thereof being soldered to a land or the like (not shown) on the circuit board P.

In the front surface of the housing 20, insertion openings 26A, 26B for the cable (cable 17 of the MD player 16) corresponding to the respective connection sections 21A, 21B are independently formed. During connection of the cable 17, connectors C22 of the cable 17 to be described later are inserted into the housing 20 through these insertion openings 26A, 26B to bring the respective conductors of the cable 17 into contact with the front resiliently deformable pieces 24*a* of the respective terminals 24. In other words, the connector assembly for the flat wire material is formed by the connector C14 (C12, C16, C18) and the connectors C22.

Tubular hoods 27 are formed around the respective insertion openings 26A, 26B, and the connectors C22 of the cable 17 are fitted into these hoods 27 during connection of the cable 17. Further, guide grooves 28 for guiding the connectors C22 of the cable 17 are formed at the opposite ends of the respective insertion openings 26A, 26B.

On the other hand, the rear surface of the housing 20 is formed with an insertion opening 30 narrow in widthwise direction and common to the both connection sections 21A, 21B, and a slider 32 is insertably and detachably supported in this insertion opening 30.

As shown in FIG. 3, the slider 32 is a narrow member extending in the widthwise direction of the housing 20, and includes a tongue 34 extending in its longitudinal direction and fixing hooks 36 at its opposite ends. The slider 32 is inserted into the housing 20 through the insertion opening 30 together with the cable 15 while being placed on the cable 15, and is attached to the housing 20 by engaging the hooks 36 with projections 38 formed on the side walls of the housing 20, thereby fixing the cable 15 inserted into the connector C14. A method for fixing the cable 15 is described in detail later.

Inside the housing 20 of the connector C14, a pair of locking pieces 40 which function also as positioning members for positioning the cable 17 (split pieces 44A, 44B to be described later) and the connectors C22 (holders 50*b* to be described later) in widthwise direction are provided near the respective insertion openings 26A, 26B and at the opposite outer sides of the respective connection sections 21A, 21B as shown in FIG. 6. Each locking piece 40 is resiliently deformable in widthwise direction and provided with a hook 40*a* at its leading end (left end in FIG. 6). When the connectors C22 mounted on the cable 17 are inserted into the housing 20 through the respective insertion openings 26A, 26B, the locking pieces 40 position the connectors C22 and the cable 17 in widthwise direction with respect to the housing 20 by coming into contact therewith, and the hooks 40*a* are engaged with locking portions 60*a* of the connectors C22 to be described later to lock the connectors C22 into the connector C14.

Figure 7:
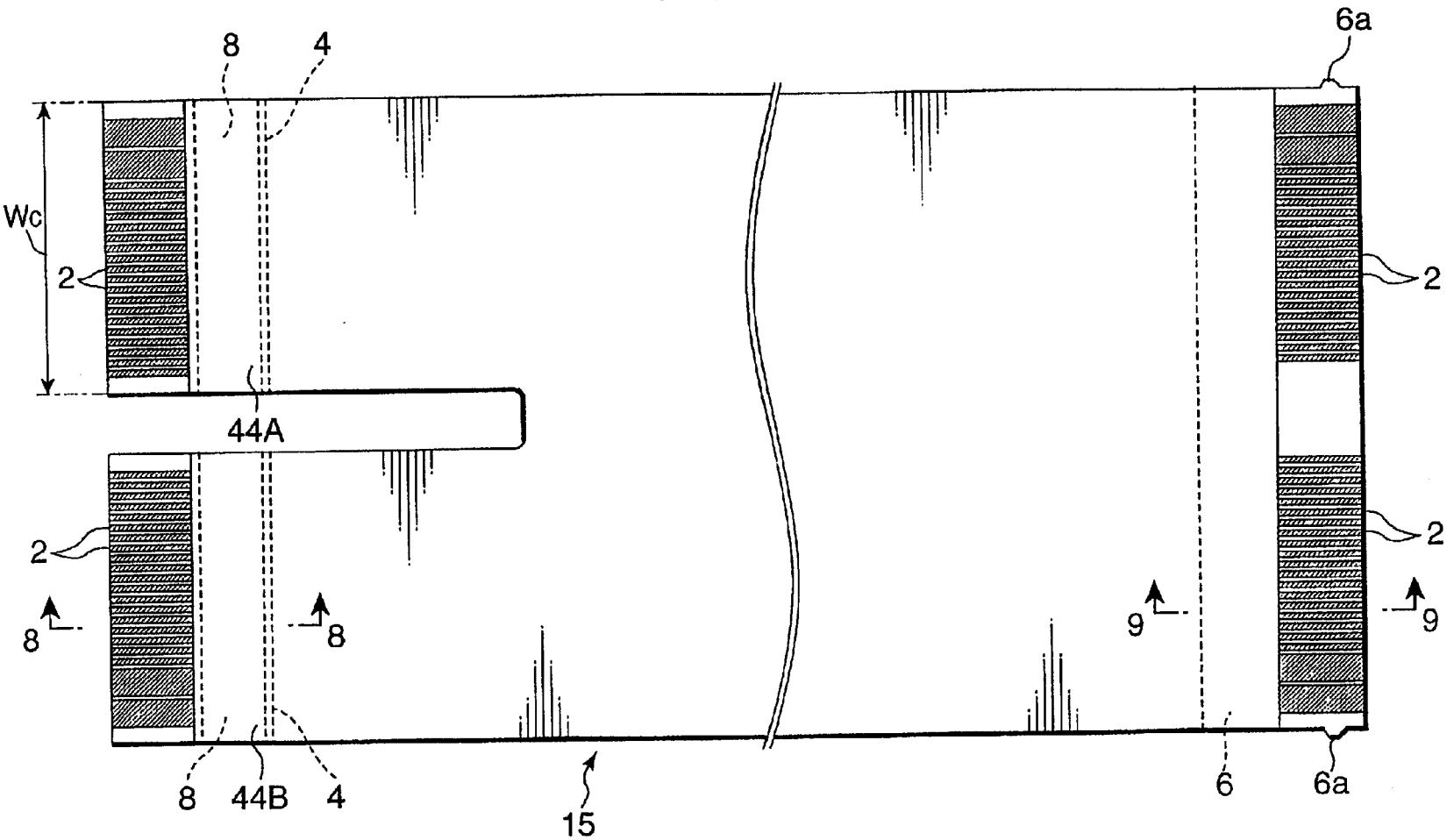
FIG. 7 is a plan view showing a construction of the flat cable.
Figure 8:
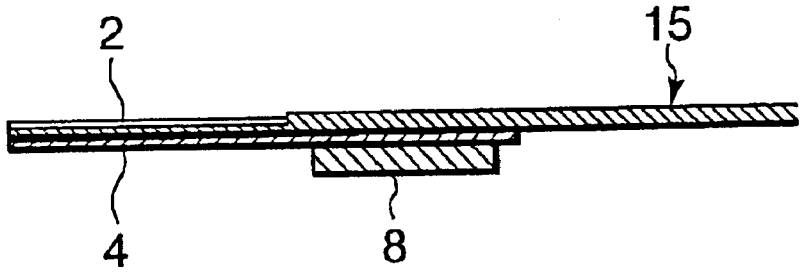
FIG. 8 is a sectional view taken along the line 8—8 of FIG. 7, showing the construction of the flat cable.
Figure 9:
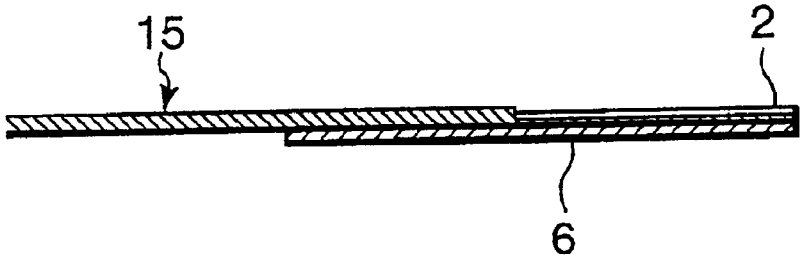
FIG. 9 is a sectional view taken along the line 9—9 of FIG. 7, showing the construction of the flat cable.

As shown in FIGS. 7 to 9, the cable 15 takes a forked structure by cutting away a middle portion (widthwise middle portion) of one end portion (left end portion of FIG. 7) to split this end portion into split pieces 44A, 44B. Ends of the cable 15 (i.e., end where the split pieces 44A, 44B are located and an end opposite therefrom) are processed to expose conductors 2, and reinforcing plates 4, 6 for restricting the deformation of the cable end portions are secured to the rear surfaces of these end portions. Positioning plates 8 are additionally secured to the reinforcing plates 4 of the split pieces 44A, 44B at a position more backward (rightward in FIG. 8) than the exposed sections of the conductors 2.

Figure 4B:
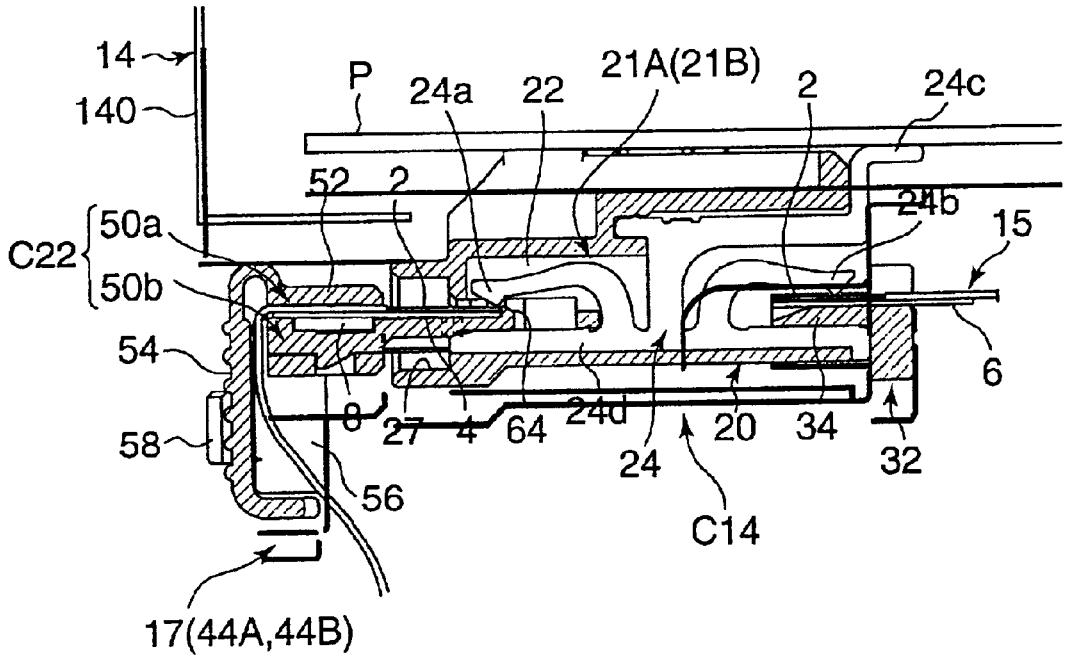

The cable 15 is connected with and fixed to the connector C14 with the end thereof opposite from the split pieces 44A, 44B inserted into the housing 20 through the insertion opening 30 in the rear surface of the connector C14. Specifically, after the end of the cable 15 is loosely fitted into the housing 20 through the insertion opening 30 in the rear surface as shown in FIG. 4A, the slider 32 is inserted into the housing 20 through the insertion opening 30 as shown in FIG. 4B. Then, the end of the cable 15 is pushed up by the tongue 34 of the slider 32, thereby fixing the conductors 2 of the cable 15 while holding them in contact with the deformable pieces 24*b* of the terminals 24 accommodated in the respective connection sections 21A, 21B. The respective conductors 2 of the cable 15 are connected with the circuits of the circuit board P via the terminals 24 by the contact thereof with the terminals 24. Partial locking projections 6*a* are formed at the opposite widthwise ends of the reinforcing plate 6 of the cable 15 as shown in FIG. 7. When the end of the cable 15 is loosely inserted into the housing 20 through the insertion opening 30 (state shown in FIG. 4A), the cable 15 can be partly locked in the housing 20 until the slider 32 is inserted by engaging the projections 6*a* with recesses 37 formed in the inner surfaces of the side walls of the housing 20 (see FIG. 6).

Although the conductors 2 are present at the middle portion (widthwise middle portion) of the cable 15 according to this embodiment, this middle portion of the cable 15 is a dead space over its longitudinal direction since the middle portion at one end portion is cut away to form the split pieces 44A, 44B as described above. Thus, the conductors 2 at the middle portion are also omitted as shown in FIG. 7 at the end of the cable 15 to be fixed to the connector C14 (i.e., end opposite from the split pieces 44A, 44B).

On the other hand, the connectors C22 (second connectors) are mounted on the ends of the respective split pieces 44A, 44B of the cable 15 as shown in FIGS. 2 and 3. Although the connectors C22 are mounted on the cable 17 in FIGS. 2 and 3, since the cables 15, 17 have a common construction as described above, following description is given with reference to FIGS. 2 and 3 for the sake of convenience.

Figure 10A:
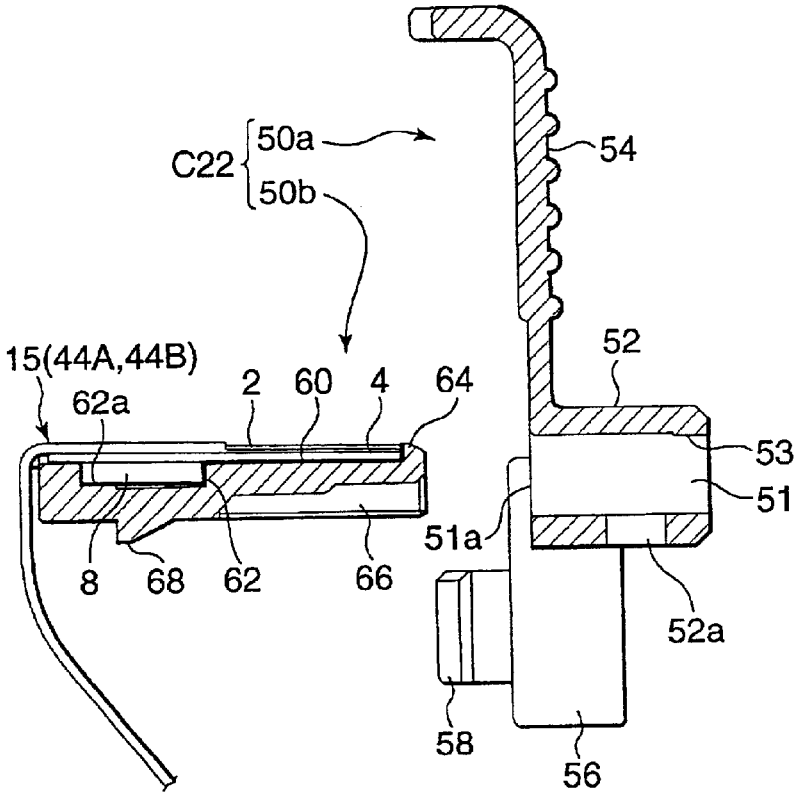
FIGS. 10A and 10B are sectional views showing the construction of the second connector before and after being connected (assembled) with the flat cable, respectively.

Each connector C22 is comprised of a housing 50a and the holder 50*b* as shown in FIGS. 3 and 10A, and is mountable on the end of the split piece 44A (44B) by inserting the holder 50*b* into the housing 50*a* while placing the holder 50*b* on the split piece 44A (44B).

Specifically, the housing 50*a* has a tubular shell portion 52 formed with an insertion hole 51 narrow in widthwise direction and penetrating in forward and backward directions (transverse direction in FIG. 10) into which hole the holder 50*b* and the like are insertable. This shell portion 52 is provided with a vertically foldable (bendable) locking piece 54 at its rear end (left end in FIG. 10A) and at an upper part of an insertion opening 51*a* of the holder 50*b*. Further, a pair of leg portions 56 including hooks 58 engageable with the locking piece 54 are provided at the opposite widthwise ends of the shell portion 52. A projection 53 for pressing the cable 15 from above is formed on the ceiling of an opening of the insertion hole 51 opposite from the insertion opening 51*a*.

Figure 11:
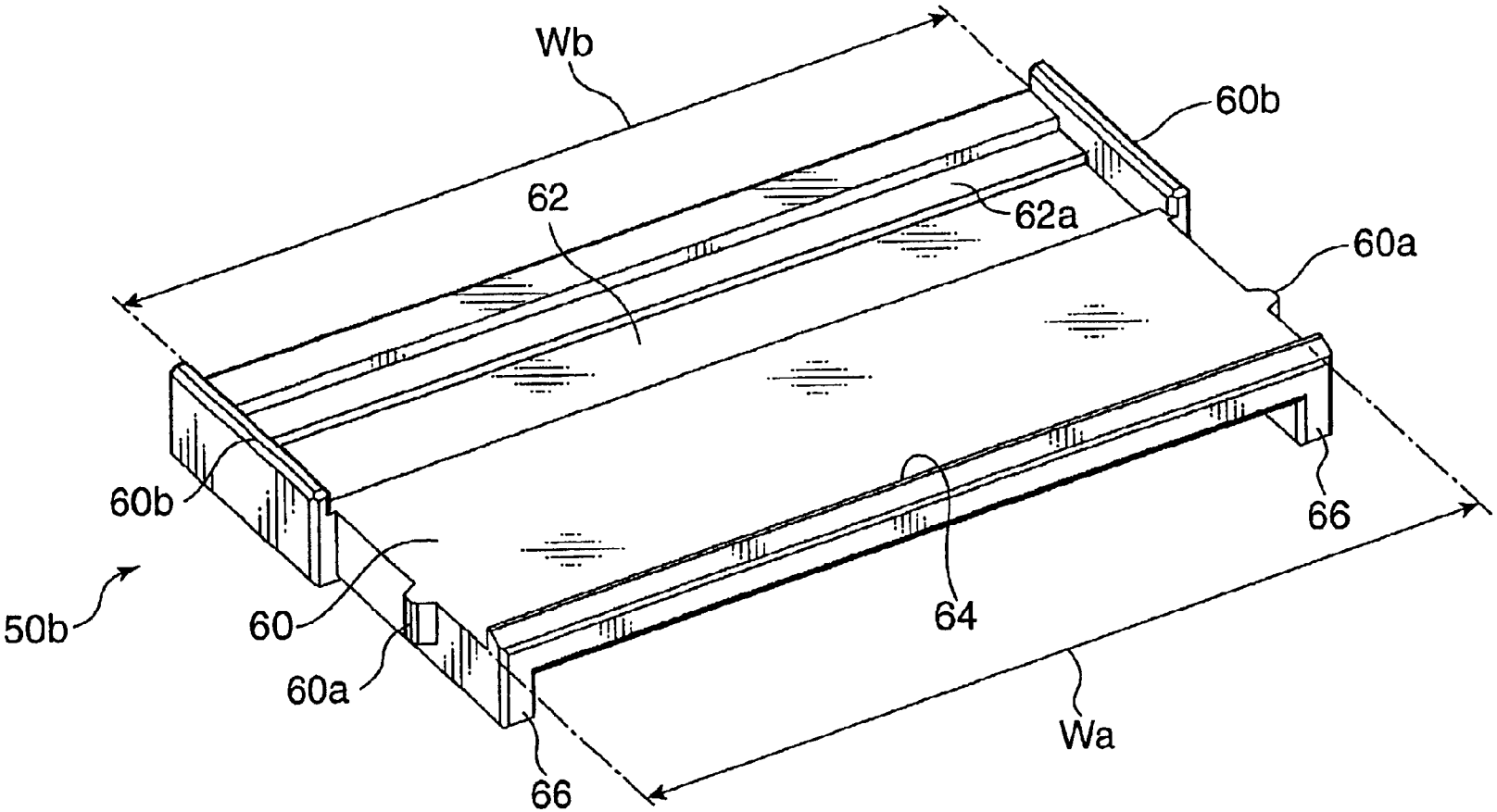
FIG. 11 is a perspective view of a holder forming the second connector.

On the other hand, the holder 50*b* is a plate member having a flat alignment surface 60 on top as shown in FIG. 11, and is placed on the rear surface (reinforcing plate 4) of the split piece 44A(44B) via the alignment surface 60. A positioning recess 62 (restricting recess) is formed at a rear part (left part in FIG. 10A) of the alignment surface 60 in order to restrict a displacement of the split piece 44A(44B) and the holder 50*b* in forward and backward directions (inserting direction into the connector C14) by fitting the positioning plate 8 of the split piece 44A(44B) into the recess 62. A protuberance 62*a* is formed at the rear end of the bottom surface of the recess 62 to slightly push up (raise) the rear end of the split piece 44A (44B) placed on the alignment surface 60.

Further, the holder 50*b* is also formed at its opposite widthwise ends with ribs 60*b* which serve as side walls of the recess 62, and an interference preventing rib 64 (protecting portion) for protecting the cable 15 from interference with a mating connector during connection is formed at the leading end (right end in FIG. 10A) of the holder 50*b*.

Further, as shown in FIG. 11, the locking portions 60*a* corresponding to the locking pieces 40 project at the opposite widthwise ends of the holder 50*b*, and a pair of guides 66 made of elongated projections extending in forward and backward directions are provided at the opposite widthwise ends of the rear surface of the holder 50*b*. As described later, when the connector C22 is connected with the connector C14, these guides 66 are guided along the guide grooves 28 of the connector C14.

The connector C22 is mounted on the split piece 44A (44B) as follows. The holder 50*b* is placed on the rear surface of the split piece 44A(44B) via the alignment surface 60 as shown in FIG. 10A, and the split piece 44A(44B) is inserted together with the holder 50*b* into the insertion hole 51 of the housing 50*a* from its leading end (i.e., from the rib 64 of the holder 50*b*) in this state. Then, the locking piece 54 is so bend as to close the insertion opening 51*a* of the housing 50*a*, and is locked so as not to return to its initial position by being pushed between the two hooks 58. In this way, the connector C22 is mounted on the split piece 44A(44B).

Figure 10B:
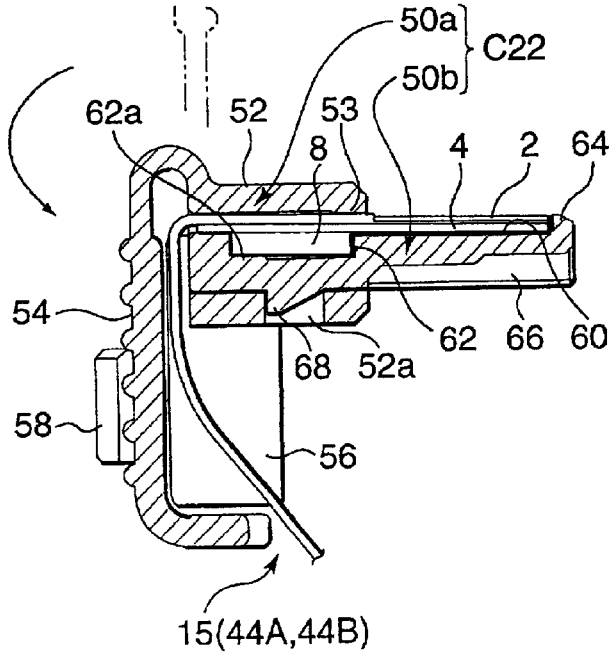

With the connector C22 mounted on the split piece 44A(44B), the exposed sections of the conductors 2 at the end of the split piece 44A(44B) are supported together with the holder 50*b* while projecting from the opposite side of the shell portion 52 of the housing 50*a* as shown in FIG. 10B. At this stage, the slit piece 44A (44B) is pushed up by the protuberance 62*a* at the rear end of the alignment surface 60 of the holder 50*b* while being pressed against the alignment surface 60 from above by the projection 53 of the housing 50*a* located more forward than the protuberance 62*a*. As a result, the split piece 44A (44B) is held slightly inclined forward, i.e., slightly inclined down from its rear end toward its leading end while the leading end thereof is held in close contact with the alignment surface 60.

When the connector C22 is attached to the split piece 44A (44B), a hook 68 formed on the rear surface of the holder 50*b* is engaged with a locking hole 52*a* formed in the inner bottom wall of the shell portion 52 of the housing 50*a* as shown in FIG. 10B, with the result that the holder 50*b* is doubly locked in the housing 50*a* in cooperation with the locking piece 54 so as not to come out of the housing 50*a*.

Here, the specific constructions of the cable 15, the connectors C14, C22 are described with reference to FIGS. 6, 7 and 11.

First, the width of the positioning plate 8 is set equal to width Wc of the split piece 44A (44B).

In the connector C22, width Wa of a portion of the alignment surface 60 of the holder 50*b* before the recess 62 is set equal to the width Wc of the split piece 44A (44B) of the cable 15 and smaller than width Wb of the recess 62. In other words, Wa=Wc<Wb. As a result, a relative displacement of the split piece 44A (44B) and the connector C22 (holder 50*b*) in widthwise direction is permitted within the range of the recess 62 (i.e., by a difference between Wc and Wb). If the split piece 44A (44B) is displaced from the holder 50*b* in widthwise direction, it bulges out (in widthwise direction) from the alignment surface 60 at the portion of the split piece 44A (44B) before the recess 62.

In the connector C14, spacing Wd between the paired locking pieces 40 is so set that the locking pieces 40 position the holder 50*b* being inserted into the connector C14 (portion of the holder 50*b* before the recess 62; hereinafter, "projecting portion") with respect to the connection section 21A (21B) in widthwise direction, and the respective locking pieces 40 are formed such that they can come into contact not only with the holder 50*b*, but also with the split piece 44A (44B) placed thereon from opposite widthwise outer sides during the above positioning.

The constructions of the connector C14, the cable 15 and the like are described above, taking the CD player 14 as an example. The connectors C16, C18, the cable 17, 19 and the like of the other players 16, 18 have the same constructions as the connector C14 and the cable 15 of the CD player 14. Further, the connector C12 to be mounted on the main circuit board 12 also has the same construction as the connector C14 of the CD player 14.

The cables 15, 17, 19 of the respective players 14, 16, 18 are bent as shown in FIG. 1, and are drawn to the tops of the front surfaces of the players 14, 16, 18 while being laid along the side surfaces of the players 14, 16, 18.

The audio unit as above is assembled as follows. First, the main circuit board 12, the CD player 14, the MD player 16 and the CS player 18 are fixed in a specified order in the casing 10, and the cables 15, 17, 19 of the respective players 14, 16, 18 are connected with the players or the like located right above. Specifically, the cable 15 of the CD player 14 is connected with the connector C12 of the main circuit board 12; the cable 17 of the MD player 16 with the connector C14 of the CD player 14; and the cable 19 of the CS player 18 with the connector C16 of the MD player 16.

Figure 12A:
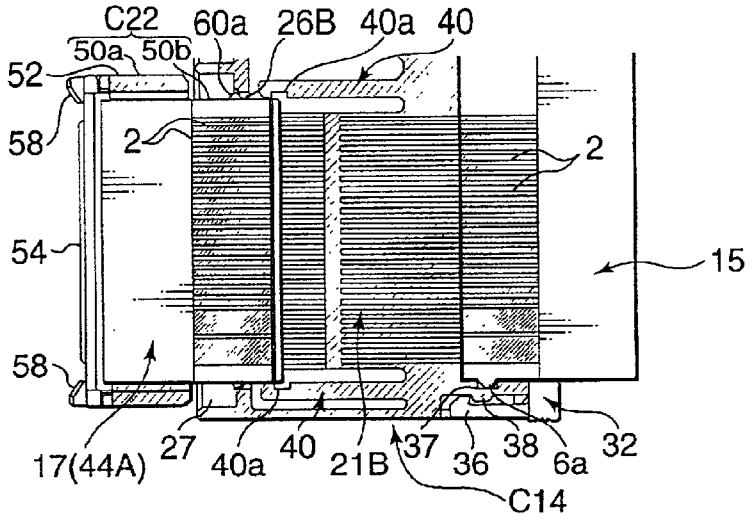
FIGS. 12A, 12B and 12C are sectional views showing constructions of the first and second connectors, corresponding to FIGS. 4B, 5A and 5B, respectively.

For example, in the case of connecting the cable 17 of the MD player 16 with the connector C14 of the CD player 14, the respective connectors C22 of the cable 17 are opposed to the respective insertion openings 26A, 26B of the connector C14, and the projecting portions of the holders 50*b* of the respective connectors C22 are inserted into the insertion openings 26A, 26B from their leading ends as shown in FIGS. 4B and 12A. At this time, the connectors C22 are inserted into the insertion openings 26A, 26B while the guides 66 of the holders 50*b* are guided along the guide grooves 28 formed in the insertion openings 26A, 26B.

Figure 5A:
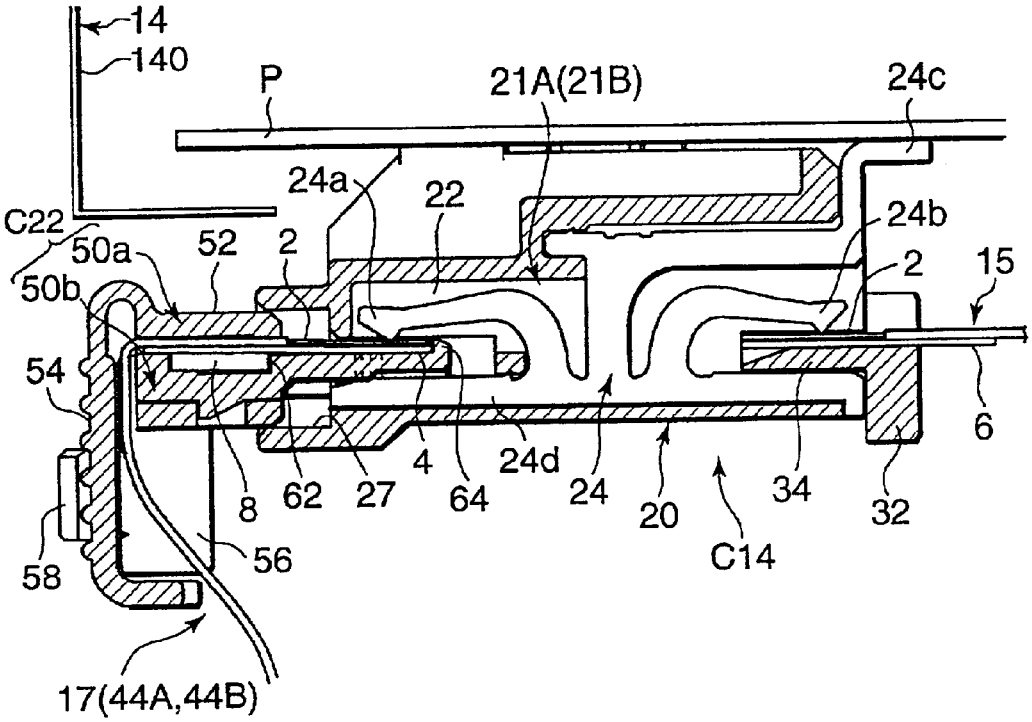
FIGS. 5A and 5B are sectional views showing constructions of the first and second connectors at an intermediate stage of and after connection of the two connectors, respectively.
Figure 5B:
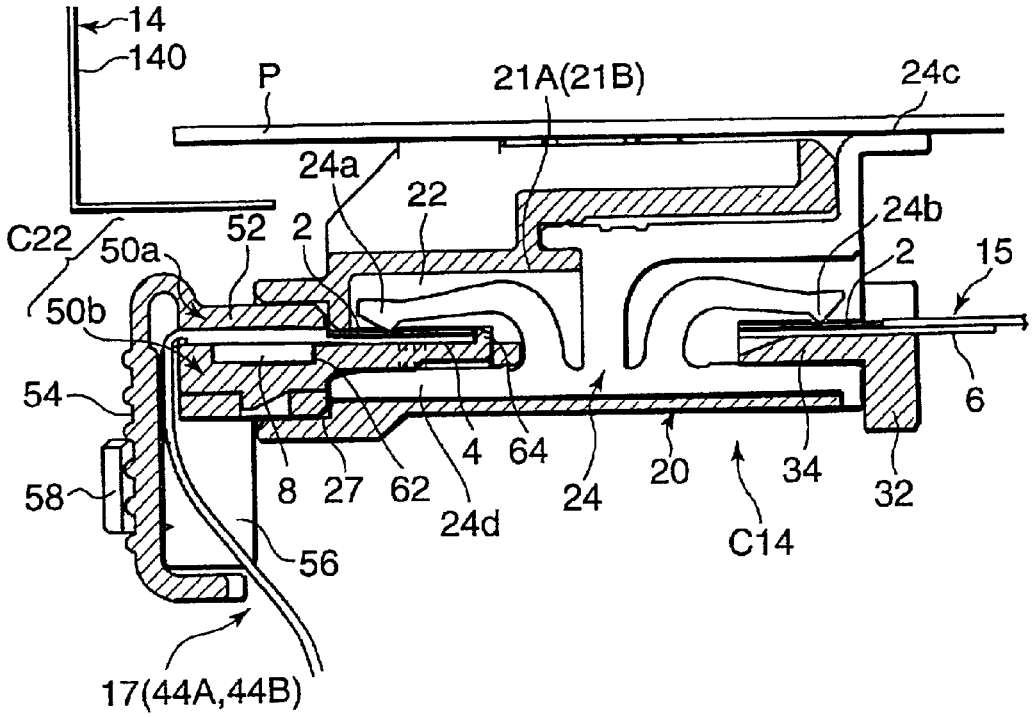
Figure 12B:
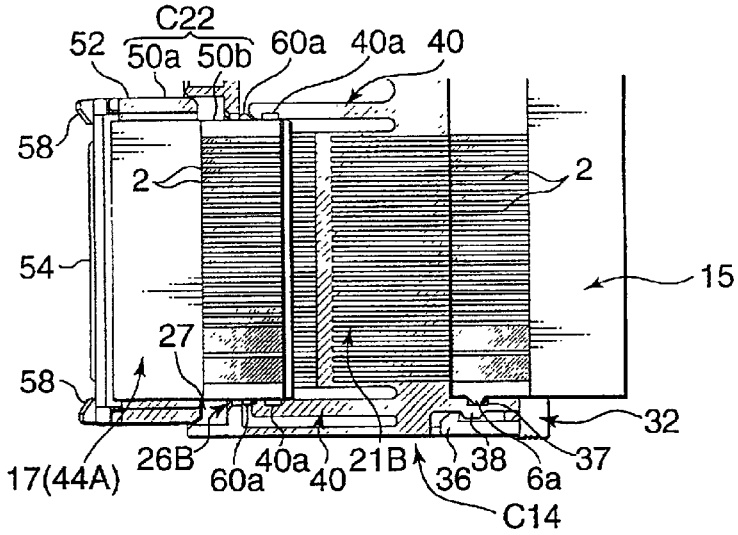
Figure 12C:
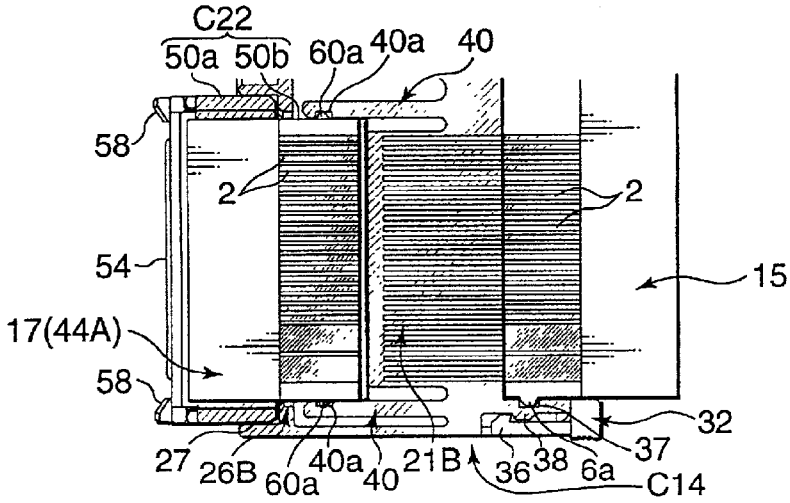

In this way, the housings 50*a* (shell portions 52) of the respective connectors C22 are fitted into the hoods 27 of the connector C14 and the projecting portions of the holders 50*b* are inserted into the connection sections 21A, 21B to be guided between the corresponding pairs of locking pieces 40, thereby positioning the holders 50*b* (connectors C22) with respect to the connection sections 21*a*, 21B in widthwise direction, i.e., a state shown in FIGS. 5A and 12A changes to a state shown in FIGS. 5B and 12B. At this time, if the split pieces 44A, 44*b* are displaced from the holders 50*b* in widthwise direction, they bulge out from the alignment surfaces 60 in widthwise direction as described above. Thus, the locking pieces 40 come into contact with the bulging portions when the projecting portions of the holders 50*b* are guided into between the locking pieces 40. As a result, the bulged-out split pieces 44A, 44B are corrected. In other words, the holders 50*b* and the cable 17 (split pieces 44A, 44B) are positioned with respect to the connection sections 21A, 21B in widthwise direction by the locking pieces 40.

As the projecting portions of the holders 50*b* are further inserted into the connection sections 21A, 21B, the pairs of locking pieces 40 are pushed to separate wider apart by the locking portions 60*a* formed in the holders 50*b*. When the holders 50*b* are inserted to the back ends of the connector C14, the hooks 40*a* of the respective locking pieces 40 are engaged with the locking portions 60*a* of the holders 50*b*, with the result that the connectors C22 are locked into the connector C14. Each locking portion 60*a* of the holder 50*b* is formed into such a substantially trapezoidal shape in plan view which is tapered from its base end toward its leading end. Accordingly, this locked state is a so-called "semi-locked" state and, when being pulled in a withdrawal direction with a specified force or larger, the connector C22 can be detached from the connector C14 while being unlocked.

When the connectors C22 are connected with the connector C14, the exposed sections of the conductors 2 of the cable 17 are inserted between the deformable pieces 24*a* and the bottom portions 24*d* of the respective terminals 24 together with the holders 50*b*, thereby bringing the deformable pieces 24*a* of the respective terminals 24 into contact with the respective conductors 2 of the cable 17. By this contact, the respective conductors 2 of the cable 17 are connected with the circuits of the circuit board P of the CD player 14 via the terminals 24, and corresponding pairs of the conductors 2 of the cable 15 of the CD player 14 connected with the rear surface of the connector C14 and those of the cable 17 are connected via the terminals 24.

The respective players 14, 16, 18 can be connected with the main circuit board 12 in a chain by connecting the cables 15, 17, 19 with the respective players located vertically adjacent to each other.

As described above, in this audio unit, the main circuit board 12 and the respective players 14, 16, 18 vertically arrayed are electrically connected in a chain by the cables 15, 17, 19 provided in the players 14, 16, 18. The ends of the cables 15, 17, 19 of the players 14, 16, 18 take a forked structure (split into the split pieces 44A, 44B), and the connectors C22 are mounted on the splits pieces 44A, 44B. On the other hand, the connectors C12, C14, C16, C18 each having two connection sections 21A, 21B corresponding to the connectors C22 are provided as mating connectors. Thus, even in the case that the cables 15, 17, 19 have quite a number of conductors 2, they can be easily and securely connected with the main circuit board 12 and the players 14, 16, 18. Specifically, according to this construction, the connecting operation for the cables 15, 17, 19 can be split: after one connector C22 of the cable 15, 17 or 19 is connected, the other connector C22 thereof is connected. Thus, an operation force necessary for one connecting operation of the connector C22 can be reduced. Therefore, even in the case that the cables 15, 17, 19 have quite a number of conductors 2, they can be easily and securely connected by splitting the connecting operation.

Further, in this audio unit, the connection construction for connecting the connector C22 with the connector C12, C14, C16, C18 is such that the split piece 44A(44B) of the cable 15, 17, 19 is supported on the holder 50*b* in a widthwise displaceable state in the connector C22 as described above and the split piece 44A(44B) is positioned with respect to the connection section 21A(21B) in widthwise direction by directly brining the locking pieces 40 provided in the mating connector C12, C14, C16, C18 into contact with the split piece 44A(44B) during connection. Thus, as compared to the conventional construction in which the cable is indirectly positioned with respect to the mating connector, there is little (hardly any) possibility of an error and the conductors of the cable 15, 17, 19 can be highly precisely positioned with respect to the mating terminals 24. Therefore, there is an effect that the respective conductors 2 of the cable 15, 17, 19 can be precisely and securely brought into contact with the mating terminals 24 even in the case that the conductors 2 and the terminals 24 are arranged at a high density (at narrow intervals).

Further, in this audio unit, the connection construction for connecting the connector C22 and the connector C12, C14, C16, C18 has following additional effects.

First, in the connector C22, the split piece 44A(44B) is pushed up by the rear end portion of the alignment surface 60 of the holder 50*b* and has the portion thereof before the above pushed-up portion pressed against the alignment surface 60 from above, thereby being held inclined down from its rear end toward its leading end with its leading end held in close contact with the alignment surface 60, and the interference preventing rib 64 is provided at the leading end of the holder 50*b*. This effectively prevents the leading end portion of the split piece 44A(44B) from coming into collision with the mating connector to thereby turn the conductors 2 up during connection of the connector C22 with the connector C12, 14, 16, 18 or effectively prevents the conductors 2 from being turned up by the deformable pieces 24*a* during insertion of the leading end of the split piece 44A(44B) into the connection section 21A(21B). Therefore, an occurrence of error electrical connection resulting from the turned-up conductors 2 can be effectively prevented.

Further, a pair of guide grooves 28 are formed at the opposite ends of each insertion opening 26A, 26B of the connector C12, C14, C16, C18, whereas a pair of guides 66 are provided in the holder 50*b* of the connector C22. The connector C22 is connected with the connector C12, C14, C16, C18 while the guides 66 of the holder 50*b* are guided along the guide grooves 28. This brings about an effect of eliminating a possibility of obliquely fitting the connector C22 into the connector C12, C14, C16, C18.

Furthermore, the cable 15, 17, 19 is fixedly connected with the connector C14, C16, C18 with the end thereof opposite from the split pieces 44A, 44B inserted into the housing 20 through the insertion opening 30 in the rear surface of the connector C14, C16, C18. At this cable end, the projections 6*a* are formed at the opposite widthwise ends of the reinforcing plate 6. Thus, when the end portion of the cable is loosely inserted into the housing 20 through the insertion opening 30, the cable can be partly locked with the housing 20 by the engagement of these projections 6*a* and the recesses 37 formed inside the housing 20 (see FIG. 6) until the slider 32 is inserted. This brings about an effect of a good operability of connecting the cable.

The audio unit described above is merely an application example of the present invention, and specific constructions of the connectors C12, C14, C16, C18 or the connectors C22 of the cables 15, 17, 19 can be suitably changed without departing from the scope and spirit of the present invention.

For example, in the foregoing embodiment, the cable 15, 17, 19 (split pieces 44A, 44B) and the holder 50*b* in the connector C22 are positioned with respect to the connection sections 21A, 21B in widthwise direction by the common locking pieces 40 (positioning portions). However, they may be positioned by separate positioning portions.

Although the present invention is applied to an electrical connection construction of an audio unit installed in a vehicle in the foregoing embodiment, it is, of course, also applicable to an other electrical connection construction such as the one for an electrical unit.

A second embodiment of the present invention is described with reference to FIGS. 13 to 19. A connector assembly for a flat wire member according to the second embodiment includes many elements common to those of the connector assemblies (connectors C14, C16, C18, C22) of the first embodiment. However, the second embodiment is irrelevant to the audio unit of the first embodiment and the detailed construction slightly differs between the two embodiments. Thus, even the elements common to the two embodiments are newly described by identifying them by different reference numerals.

Figure 13:
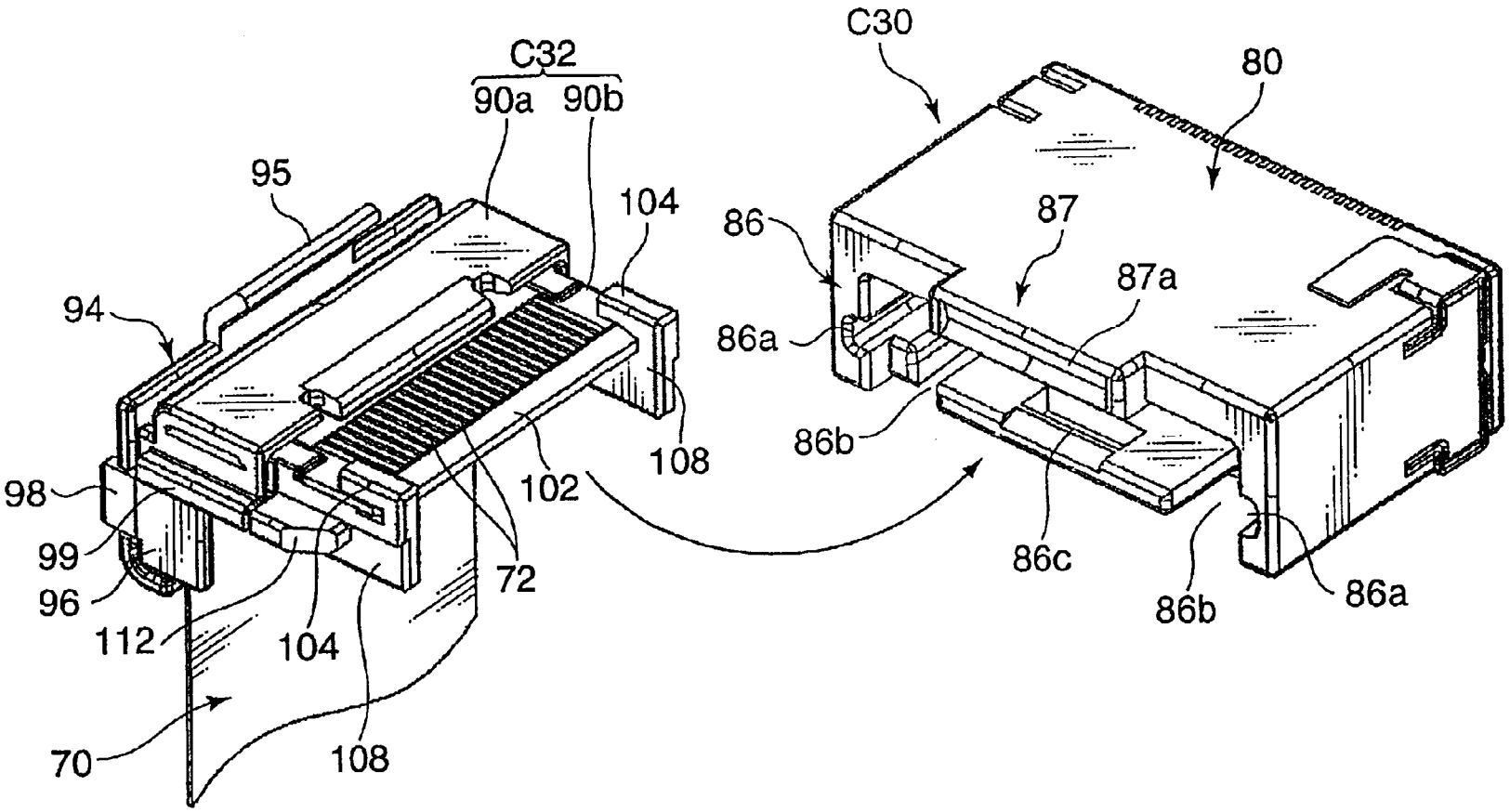
FIG. 13 is a perspective view showing a connector assembly for a flat wire member according to another embodiment of the invention.
Figure 17A:
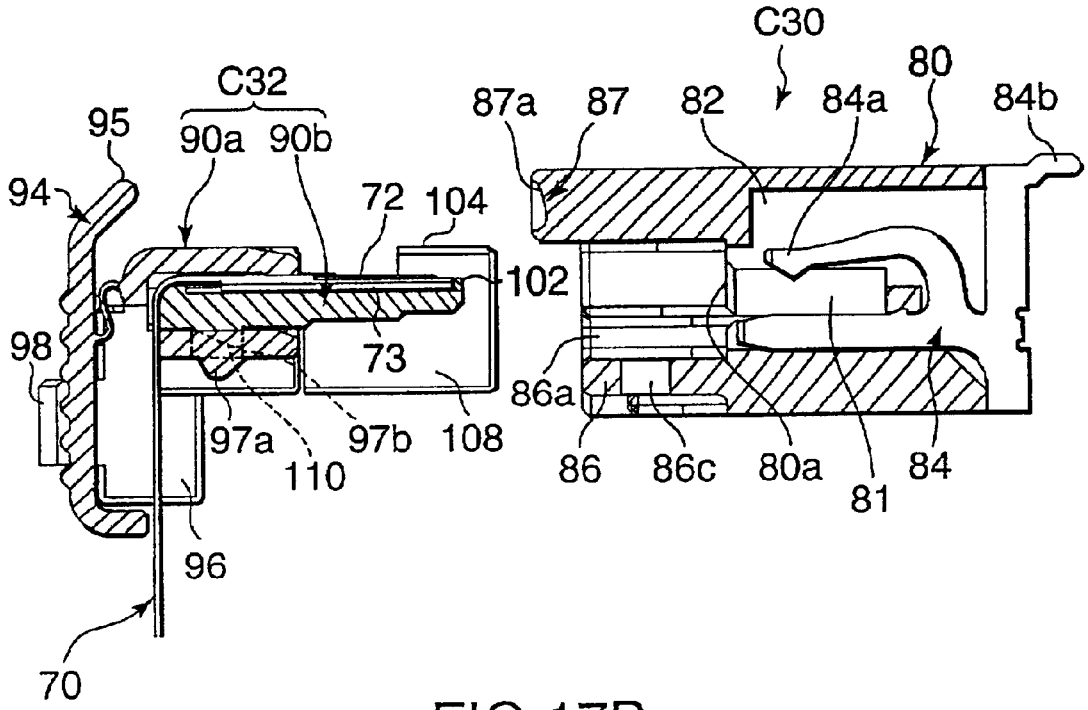

FIGS. 13 and 17A show a connector assembly for a flat wire member according to the second embodiment, wherein FIG. 13 is a perspective view of the connector assembly and FIG. 17A is a longitudinal section of the connector assembly.

As shown in FIGS. 13 and 17A, this connector assembly is comprised of a board-side connector C30 (first connector) to be mounted on a circuit board or the like and a wire-side connector C32 (second connector) to be mounted on an end portion of a flat cable 70 (flat wire member).

The board-side connector C30 (hereinafter, "connector C30)" has a housing 80 narrow in widthwise direction and corresponding to the flat cable 70 (hereinafter, "cable 70").

A multitude of cavities 82 are arrayed in widthwise direction (direction normal to the plane of FIG. 17A) inside the housing 80, and terminals 84 are accommodated in the respective cavities 82. Each terminal 84 includes, at its front end (left end in FIG. 17A), a deformable piece 84*a* for connection which is vertically resiliently deformable and a leg portion 84*b* behind the deformable piece 84*a*. Each terminal 84 is electrically connected with a circuit (pattern) on the circuit board by having the leg portion 84*b* soldered to a fixing land or the like of the circuit board.

An insertion opening 80*a* for the cable 70 is formed in the front surface (left surface in FIG. 17A) of the housing 80, and a tubular hood 86 is integrally formed around the insertion opening 80*a*. A cam follower 87 provided with a sliding surface 87*a* on which a later-described cam 95 provided in the wire-side connector C32 can slide is integrally formed at the upper front end of the hood 86. Further, guide grooves 86*a* and slits 86*b* for guiding the wire-side connector C32 are formed in the inner side surfaces and the inner bottom surface of the hood 86, respectively, and a locking hole 86*c* for locking the wire-side connector C32 is formed in the inner bottom surface of the hood 86.

On the other hand, the wire-side connector C32 (hereinafter, "connector C32") is comprised of a housing main body 90*a* and a holder 90*b*, and is mountable on an end portion of the cable 70 by placing the holder 90*b* on the cable 70 and inserting them together into the housing main body 90*a*.

Figure 14:
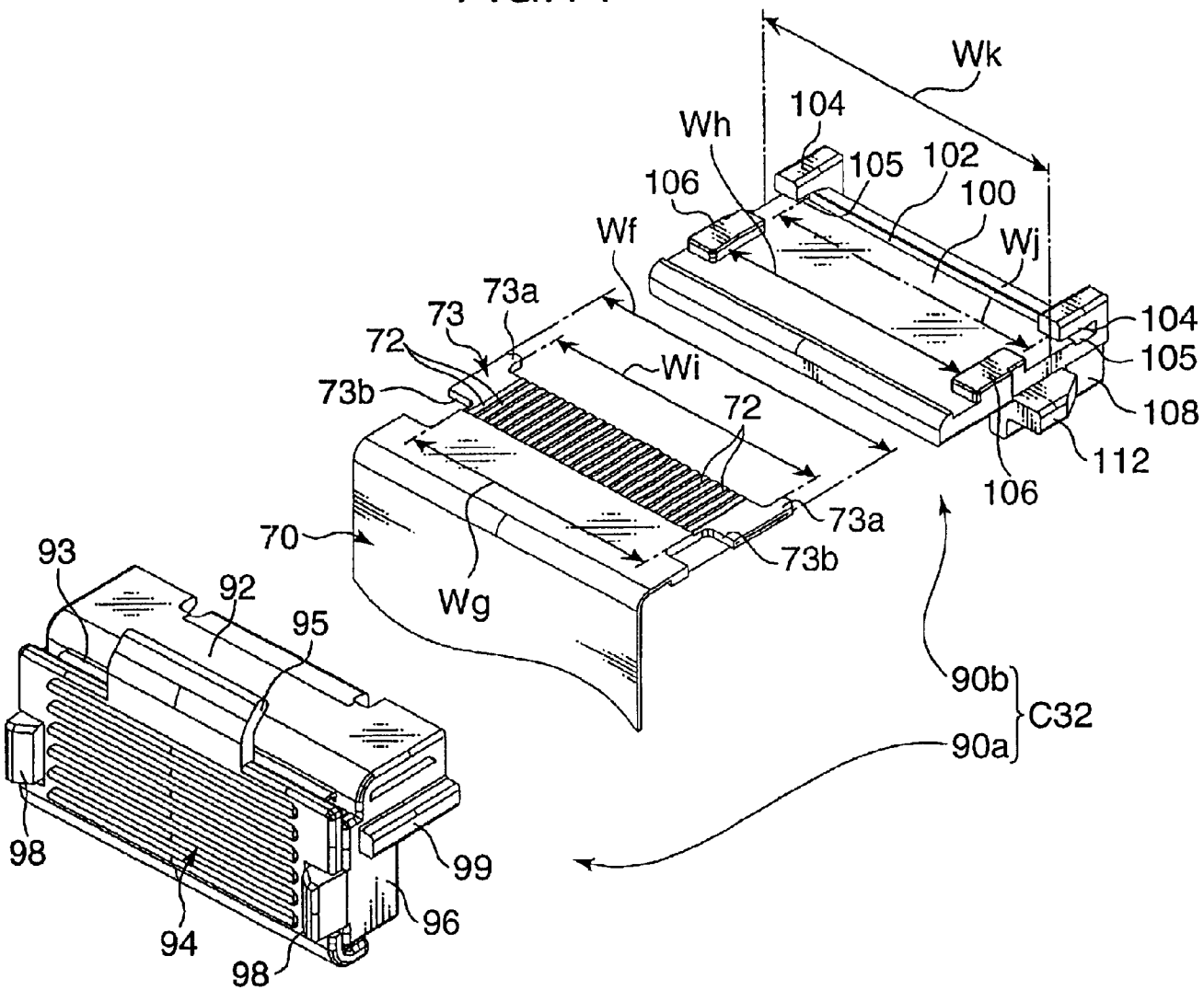
FIG. 14 is an exploded perspective view showing a construction of a connector for a flat cable.
Figure 15:
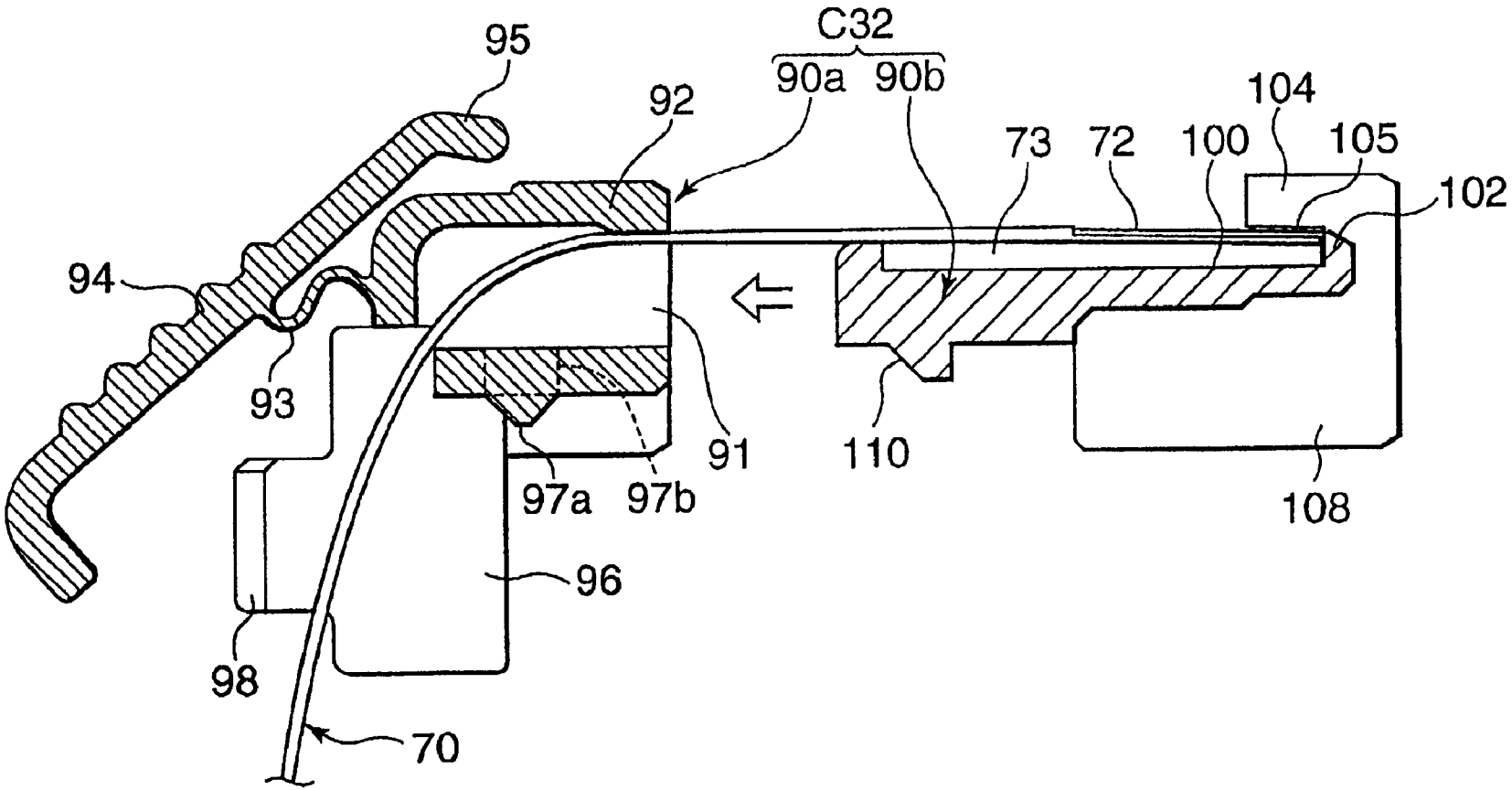
FIG. 15 is an exploded section showing the connection of the cable connector.

More specifically, the housing main body 90*a* includes a tubular shell portion 92 formed with an insertion hole 91 penetrating the housing main body 90*a* in forward and backward directions (transverse direction in FIG. 15) for insertion of the holders 90*b* and the like as shown in FIGS. 14 and 15. This shell portion 92 is provided with a vertically foldable (bendable) locking piece 94 via a coupling piece 93 at its upper rear end (upper left end in FIG. 15), and a pair of leg portions 96 including hooks 98 for locking the bent-down locking piece 94 are provided at the opposite sides of the shell portion 92 with respect to widthwise direction (direction normal to the plane of FIG. 15).

The cam 95 projects in the widthwise center of the upper part of the locking piece 94. When the connector C32 is mounted on the cable 70 and the locking piece 94 is locked, the cam 95 stands on top of the connector C32 (see FIG. 13).

Figure 16:
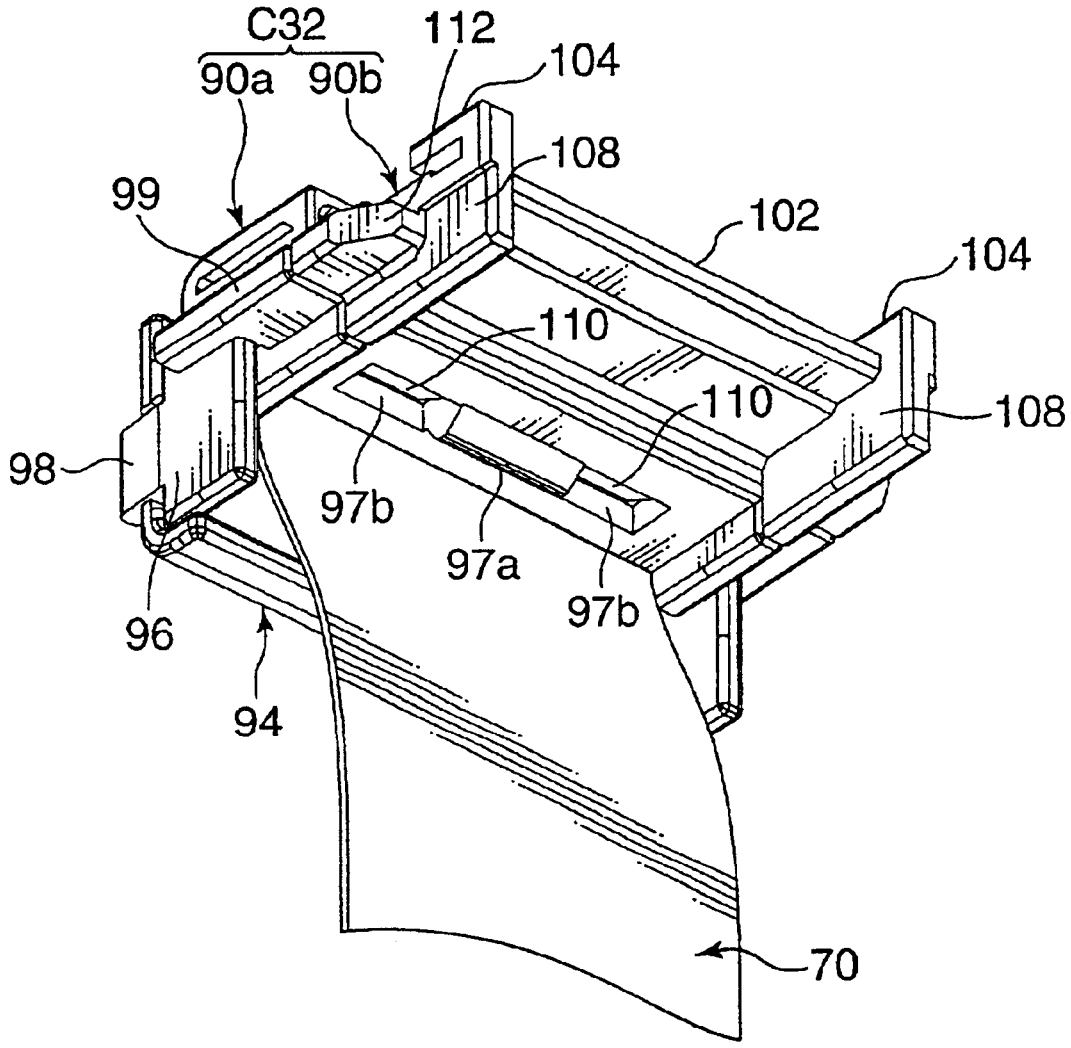
FIG. 16 is a perspective view showing the connection of the cable connector.

Further, a locking portion 97*a* for locking the connector C32 into the connector C30 is provided substantially at a widthwise center position of the bottom surface of the shell portion 92, and a pair of locking holes 97*b* for locking the holder 90*b* are provided at the opposite sides of the locking portion 97*a* (see FIG. 16). Further, elongated projections 99 extending in forward and backward directions are formed on the opposite sides of the shell portion 92.

On the other hand, the holder 90*b* is formed at its upper part with an alignment surface 100, on which the rear surface of the cable 70 is to be placed.

A rib 102 extending in widthwise direction is formed at the front end (right end in FIG. 16) of the alignment surface 100, and cable pressing portions 104 are provided at the outer sides of the rib 102. Slit-shaped inserting portions 105 are formed between the cable pressing portions 104 and the alignment surface 100. Further, projections 106 for positioning the cable 70 in forward and backward directions are provided substantially at center positions of the opposite widthwise ends of the alignment surface 100 with respect to forward and backward directions.

A pair of guides 108 extending in forward and backward directions are provided at the opposite widthwise ends of the bottom surface of the holder 90*b*, and a pair of hooks 110 (see FIG. 16) for locking the housing main body 90*a* are formed between these guides 108. Further, elongated projections 112 extending in forward and backward directions are formed at the opposite sides of the holder 90*b*.

Ends of the cable 70 are processed to expose the respective conductors 72, and reinforcing plates 73 for restricting the deformation of the cable end portions are secured to the rear surfaces of these end portions. A pair of bulging portions 73*a* bulging out more forward than the front end of the conductors 72 are formed at the opposite widthwise ends of the leading end of each reinforcing plate 73, and a pair of notches 73*b* opening outward sideways so as to correspond to the projections 106 of the holder 90*b* are formed behind these bulging portions 73*a*.

The thus constructed connector C32 is mounted on the cable 70 as follows. First, as shown in FIG. 15, the cable 70 is passed through the housing main body 90*a* by inserting the end portion of the cable 70 into the insertion hole 91 from behind (left side in FIG. 15) the shell portion 92 with the locking piece 94 of the housing main body 90*a* opened, and the rear surface of the cable 70 is placed on the holder 90*b* in this state. Specifically, the respective bulging portions 73*a* of the reinforcing plate 73 are inserted into the corresponding inserting portions 105 by holding the rib 102 from the opposite sides, and the cable 70 is placed on the alignment surface 100 of the holder 90*b* with the respective notches 73*b* of the reinforcing plate 73 aligned with the corresponding projections 106 of the holder 90*b*. In this way, the forward and backward movements of the reinforcing plate 73 are restricted by the projections 106 and the exposed sections of the conductors 72 are positioned with respect to the holder 90*b* in forward and backward directions.

Figure 17B:
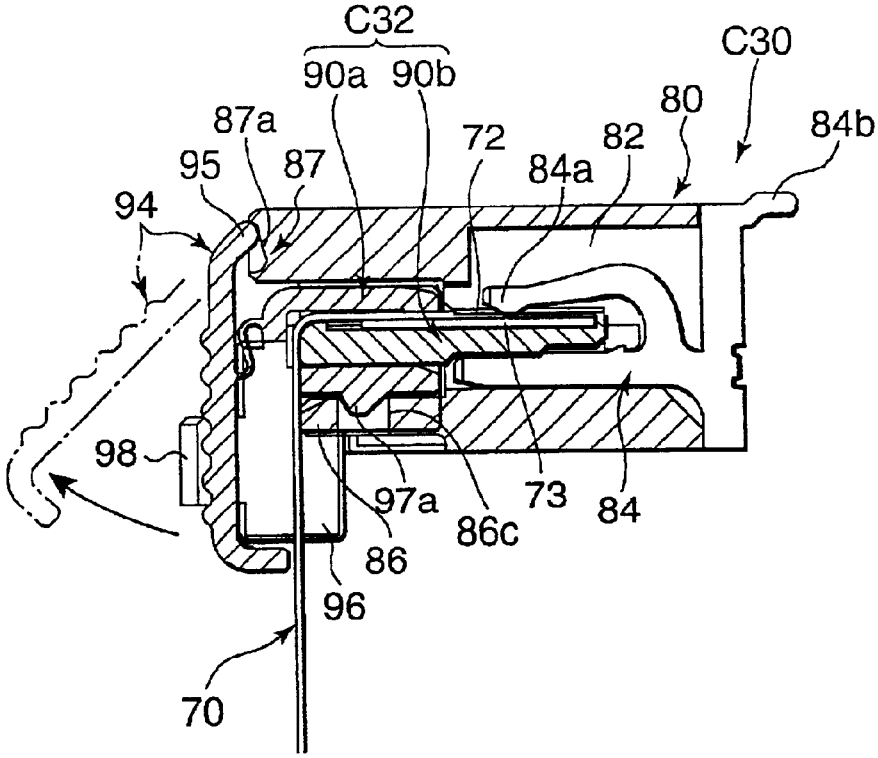

Next, the holder 90*b* is inserted into the insertion hole 91 of the housing main body 90*a* from its rear end (end opposite from the rib 102). Then, as shown in FIGS. 16 and 17B, the hooks 110 formed on the rear surface of the holder 90*b* are engaged with the locking holes 97*b* of the housing main body 90*a*, thereby locking the holder 90*a* so as not to disengage from the hosing main body 90*a*. The locking piece 94 is then bent to close the insertion hole 91 of the housing main body 90*a* from behind and further pushed between the hooks 98 to be locked. As a result, mounting of the connector C32 on the cable 70 is completed.

When the connector C32 is mounted on the cable 70 in this way, the exposed sections of the conductors 72 at the end portion of the cable 70 are supported together with the holder 90*b* while projecting forward of the housing main body 90*a*. Further, guides (used to connect the connector C32 with the connector C30) extending in forward and backward directions are formed by the elongated projections 99, 112 of the housing main body 90*a* and the holder 90*b*.

In the connector C32 and the cable 70, width Wf of the reinforcing plate 73 is set equal to that of the cable 70; spacing Wg between inner sides of the notches 73*b* is set narrower than spacing Wh between the projections 106 of the holder 90*b*; and spacing Wi between the bulging portions 73*a* is set wider than width Wj of the rib 102 of the holder 90*b*. Further, width Wk of the alignment surface 100 is set equal to the width Wf (i.e., width of the cable 70) of the reinforcing plate 73. In other words, by the above dimensioning, a relative widthwise displacement of the cable 70 and the connector C32 (holder 90*b*) is permitted, and a lateral edge of the cable 70 bulges out (in widthwise direction) from the alignment surface 100 if the cable 70 is displaced from the holder 90*b* in widthwise direction.

Further, in the connector C30, spacing between inner side walls 81 (see FIGS. 17A and 19) of the housing 80 in a terminal accommodating section is set such that the holder 90*b* inserted into the terminal accommodating section through the insertion opening 80*a* can be positioned in widthwise direction. In other words, the inner side walls 81 of the housing 80 function as the positioning portion of the present invention in the second embodiment.

In the connector assembly for the flat wire member according to the second embodiment, the cable 70 is connected with the circuit board or the like on which the connector C30 is mounted as follows. The connector C32 is opposed to the connector C30 as shown in FIG. 17A and then inserted into the housing 80 of the connector C30 from the leading end of the holder 90*b*. At this time, the connector C32 is inserted while the guides (formed by the elongated projections 99, 112) at the sides of the connector C32 and the guides 108 at the bottom of the connector C32 are guided along the guide grooves 86*a* and the slits 86*b* of the housing 80.

In this way, the housing main body 90*a* (shell portion 92) of the connector C32 is inserted into the hood 86 of the connector C30 and the holder 90*b* is inserted into the terminal accommodating section through the insertion opening 80*a*, with the result that the holder 90*b* (connector C32) is positioned in widthwise direction by the inner side walls 81 of the housing 80 in the terminal accommodating section. At this time, if the cable 70 is displaced from the alignment surface 100 of the holder 90*b* in widthwise direction, it bulges out in widthwise direction from the alignment surface 100. Thus, the inner side wall 81 comes into the bulged portion while the leading end of the holder 90*b* is being guided into the terminal accommodating section through the insertion opening 80*a*. As a result, the cable 70 is pushed back to be properly placed on the alignment surface 100. In this way, the holder 90*b* and the cable 70 are positioned in widthwise direction in the terminal accommodating section.

When the connectors C30 and C32 are completely connected with each other, the deformable pieces 84*a* of the respective terminals 84 are in contact with the exposed sections of the conductors 72 of the cable 70 as shown in FIG. 17B and the locking portion 97*a* of the connector C32 enters the locking hole 86*c* of the hood 86 to lock the connectors C30, C32 into each other. Further, the cam 95 of the locking piece 94 of the connector C32 is in contact with the cam follower 87 (sliding surface 87*a*) of the connector C30.

The connector C32 connected with the connector C30 is detached by unlocking the locking piece 94 of the connector C32.

Specifically, as indicated by phantom line in FIG. 17B, the bottom end of the locking piece 94 is pulled up by fingertip to cancel the locked state by the hook 98. Then, with the leading end of the cam 95 held in contact with the cam follower 87, the locking piece 94 pivots (rotates) about this contact portion, and the connector C32 is moved in withdrawing direction (detaching direction) according to this pivotal movement of the locking piece 94. When the locking piece 94 is pulled up to a specified position, a partly connected state is reached in which the connector C32 is mostly pulled out of the connector C30. The connector C32 can be detached from the connector C30 by gripping and pulling the locking piece 94 out in this state.

Also in the above-described connector assembly for the flat wire member according to the second embodiment, the cable 70 is so supported as to be displaceable in widthwise direction in the connector C32 and is positioned in widthwise direction in the terminal accommodating section by the inner side walls 81 of the mating connector C30 directly coming into contact with the cable 70 (portion of the reinforcing plate 73) during connection of the connectors C32 and C30. Therefore, similar to the connector assembly of the first embodiment, the conductors 72 of the cable 70 can be precisely and securely brought into contact with the corresponding mating terminals 84.

Particularly, in the connector assembly of the second embodiment, the respective conductors 72 of the cable 70 can be more precisely positioned with respect to the mating terminals 84 since the bulging portions 73*a* are provided at the leading end of the cable 70 (reinforcing plate 73) as shown in FIG. 14.

Figure 18A:
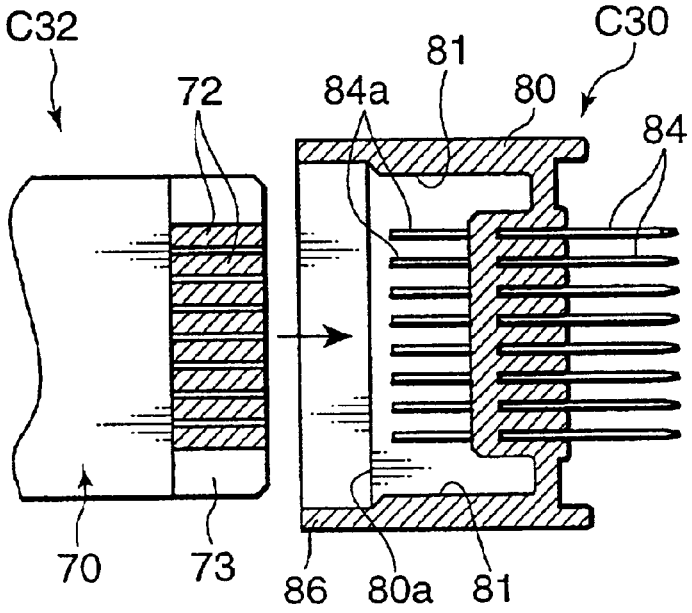
FIGS. 18A and 18B are diagrammatic plan views showing positioning precision of the flat cable during connection of the connectors in a case where the flat cable is not provided with bulging portions.
Figure 18B:
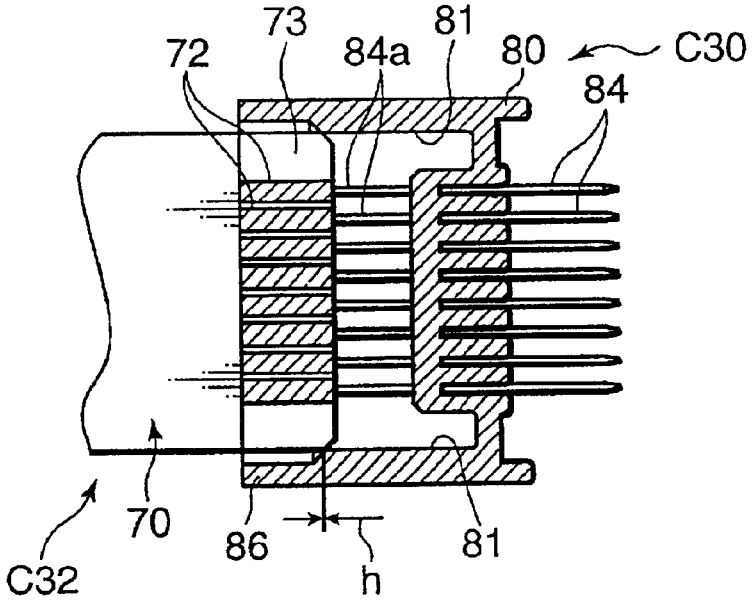
Figure 19A:
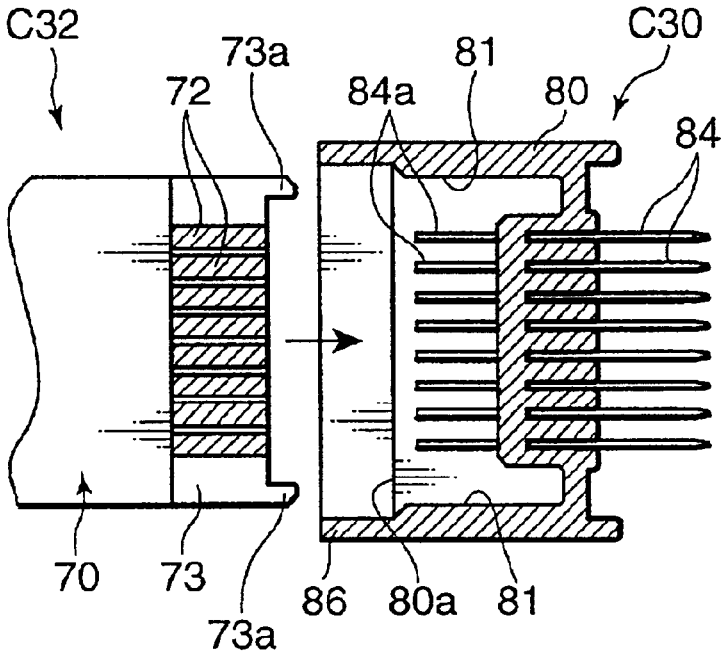
FIGS. 19A and 19B are diagrammatic plan views showing positioning precision of the flat cable during connection of the connectors in a case where the flat cable is provided with the bulging portions.
Figure 19B:
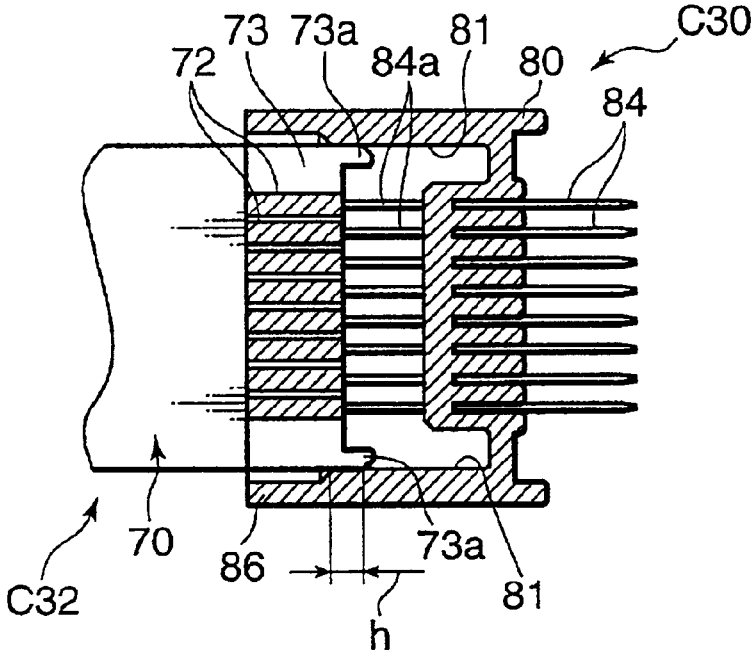

This advantage is described in detail with reference to FIGS. 18 and 19. For example, in the case that the bulging portions 73*a* are not provided, the deformable pieces 84*a* may be brought into contact with the cable 70, for example, while the widthwise displacement of the cable 70 is not completely corrected when the leading end of the cable 70 is inserted into the terminal accommodating portion through the insertion opening 80*a* as shown in FIG. 18A since a distance h between a position where the cable 70 starts being restricted in widthwise direction by the inner side walls 81 and a position where the deformable pieces 84*a* start contacting the cable 70 (press-contact) is short (see FIG. 18B). Contrary to this, in the case that the cable 70 is provided with the bulging portions 73*a*, the distance h is longer (see FIG. 19B) when the leading end of the cable 70 is inserted into the terminal accommodating section through the insertion opening 80*a* as shown in FIG. 19A. Thus, the widthwise displacement of the cable 70 can be more securely corrected until the deformable pieces 84*a* come into contact with the cable 70. Therefore, as compared to the first embodiment, the respective conductors 72 of the cable 70 can be more precisely brought into contact with the corresponding mating terminals 84.

Although the flat cables 15, 17, 19, 70 are used as flat wire members in the foregoing embodiment, the flat wire members are not limited to flat cables. Ribbon wires, FPCs (flexible printed circuits) and the like may be used as such.

In the connector assembly for the flat wire member, the end portion of the flat wire member is inserted into the first connector together with the supporting member of the second connector and brought into contact with the terminals by connecting the second connector holding the flat wire member with the first connector accommodating the terminals. The flat wire member is so held on the supporting member as to be displaceable in widthwise direction which is normal to the inserting direction of the flat wire member into the first connector and, when the flat wire member is inserted into the first connector by connecting the first and second connectors, the positioning member provided in the first connector directly comes into contact with the flat wire member to position the flat wire member in widthwise direction with respect to the first connector. Thus, there is a lower possibility of an error as compared to the conventional connectors of this type, and the conductors of the flat wire member can be highly precisely positioned with respect to the mating terminals. Therefore, even in the case that the conductors and the mating terminals are arrayed at a high density (at narrow intervals), the respective conductors of the flat wire member can be precisely and securely brought into contact with the corresponding mating terminals.

As described above, an inventive connector assembly for a flat wire member, comprises: a first connector for accommodating terminals, the first connector being provided with a positioning portion; and a second connector for holding a flat wire member, the second connector including a plate-shaped supporting member supporting a leading end portion of the flat wire member in such a way as to be movable in a widthwise direction which is normal to an inserting direction of the flat wire member into the first connector, whereby the flat wire member being positioned with respect to the first connector in the widthwise direction by directly coming into contact with the positioning portion of the first connector.

In the connector assembly thus constructed, when the flat wire member is inserted into the first connector, the positioning member provided in the first connector directly comes into contact with the flat wire member. If the wire member is displaced in widthwise direction, it is relatively moved in widthwise direction with respect to the supporting member, thereby correcting such a displacement. A precision of positioning the respective conductors and the mating terminals can be improved by directly positioning the flat wire member with respect to the first connector.

In the case of using the flat wire member, a reinforcing plate for preventing a resilient deformation is generally adhered to the rear surface or the like of the flat wire member. Thus, the "flat wire member" includes not only the flat wire member itself, but also the reinforcing plate when the reinforcing plate is adhered to the flat wire member.

Preferably, a pair of bulging portions are further provided which are provided at the opposite widthwise ends of the leading end of the flat wire member with respect to the inserting direction and project more forward in the inserting direction than conductors for coming into contact with the positioning portion from inner sides.

With this construction, a distance (dimension in the inserting direction) between a position where the flat wire member starts contacting the positioning member and a position where the conductors are brought into contact (press-contact) with the mating terminals can be extended by the length of the bulging portions. Thus, the flat wire member can be more securely positioned in widthwise direction until the conductors are brought into contact (press-contact) with the mating terminals.

Preferably, the positioning portion also acts to position the supporting member in widthwise direction by coming into contact with the supporting member being inserted into the first connector from widthwise outer sides. The width of the leading end portion of the supporting member is made to be the same or smaller than that of the leading end portion of the flat wire member. The positioning portion can come into contact with the flat wire member supported on the supporting member.

With this construction, the supporting member is positioned in widthwise direction by the positioning member and the flat wire member is also positioned in width direction while the supporting member is being inserted into the first connector.

In such a case, a restricting member is preferably mounted on the underside of the flat wire member and fittable into a restricting recess formed in the supporting member with the flat wire member supported on the supporting member. In this fitted state, the restricting recess preferably hinders a movement of the restricting member in the inserting direction while permitting a movement of the restricting member within a specified range along widthwise direction.

With this construction, the flat wire member can be supported on the supporting member in such a state as to be movable in widthwise direction while a relative displacement thereof with respect to the supporting member in the inserting direction is hindered.

The connector assembly may be preferably provided with means for placing the flat wire member in a state that the flat wire member inclines down in the inserting direction on the supporting member. In the connector assembly of this type, if the leading end portion of the flat wire member held by the second connector is raised from the supporting member or oriented upward, the leading end portions of the conductors may be turned up by, e.g., a contact with the mating connector during insertion of the flat wire member into the first connector, thereby hindering the contact of the conductors with the mating terminals. Thus, the second connector preferably supports the flat wire member such that the flat wire member is inclined down on the supporting member from its rear end toward its leading end with respect to the inserting direction by pushing the flat wire member up while pressing a portion of the flat wire member located before the pushed-up portion thereof with respect to the inserting direction from above.

In such a case, if the supporting member is formed with a protecting portion for protecting the leading end of the flat member with respect to the inserting direction, the leading end portion of the flat wire member can be protected from, e.g., the contact with the first connector during insertion of the flat wire member into the first connector. This can more securely prevent the conductors from being turned up.

This application is based on patent application Nos. 2001-4940 and 2001-369113 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A connector assembly for a flat wire member having a plurality of wirings integrated with each other in a flat shape, comprising:

a first connector including connecting terminals accommodated therein, each terminal having a contact arm, and a second connector for holding the flat wire member, the second connector including a plate-shaped supporting member for supporting a leading end portion of the flat wire member and a housing for retaining the leading end portion on the supporting member, the supporting member and the housing holding the leading end portion in such a way that the leading end portion is movable in its widthwise direction relative to the supporting member, with a portion of the leading end portion being exposed on the housing, the first and second connectors having structures to couple the connectors with each other by slidably fitting portions of the connectors one on the other, with the leading end portion of the flat wire member being inserted into the first connector to engage the wirings with the contact arms, and the first connector further including a positioning member which is to engage a side of the leading end portion of the flat wire member to position the leading end portion in its widthwise direction relative to the contact arm when the leading end portion is inserted into the first connector.

2. A connector assembly according to claim 1, wherein the width of the leading end portion of the supporting member is the same or smaller than that of the leading end portion of the flat wire member such that a portion of the leading end portion of the flat wire member goes out of the plate-shaped supporting member to be engaged and positioned by the positioning member upon insertion of the leading end portion of the flat wire member into the first connector.

3. A connector assembly according to claim 1, wherein the second connector further include a restricting member fixedly mounted on an underside of the flat wire member, and the plate-shaped supporting member is formed with a restricting recess for receiving the restricting member to prevent the restricting member from moving, relative to the plate-shaped supporting member, in the direction of the insertion of the leading end portion of the flat wire member, while allowing the movement of the restricting member to move in the widthwise direction of the flat wire member relative to the plate-shaped supporting member.

4. A connector assembly according to claim 1, wherein the second connector further includes means for placing the flat wire member on the plate-shaped supporting member in a state that the leading end portion of the flat wire member is inclined downward toward its leading end with respect to the plane of the plate-shaped supporting member to prevent interference between the leading end and the first connector when the leading end portion of the flat wire member is inserted into the first connector.

5. A connector assembly according to claim 1, wherein the flat wire member has a first end portion and a second end portion, the first connector has a first hood portion and second hood portion, the second connector includes a first plate-shaped supporter and a second plate-shaped supporter for restrictively supporting the first and second end portions of the flat wire member, and a first housing and a second housing for respectively holding the first and second end portions of the flat wire member, and the first and second end portions of the flat wire member are respectively inserted into the first and second hood portions.

6. A connector assembly according to claim 1, wherein the flat wire member is formed with a pair of recesses and a plate-shaped supporter is formed with a pair of projections on the opposite sides of the supporter, the projections being respectively received by the recesses when the supporter supports the leading end portion of the flat wire member, the distance between the projections being larger than the distance between bottom sides of the recesses to allow the leading end portion of the flat wire member to move in its widthwise direction.

7. A connector assembly according to claim 1, wherein the flat wire member is formed with a pair of protruding portions protruding from a leading edge of the leading end portion of the flat wire member at its opposite widthwise ends, the protruding portions extending in the direction in which the leading end portion is inserted into the first connector, such that the protruding portions come into contact with the positioning member before the wirings on the flat wire member is inserted in the first connector.

8. A connector assembly according to claim 7, wherein the second connector further include a restricting member fixedly mounted on an underside of the flat wire member, and the plate-shaped supporting member is formed with a restricting recess for receiving the restricting member to prevent the restricting member from moving relative to the plate-shaped supporting member, in the direction of the insertion of the leading end portion of the flat wire member, while allowing the movement of the restricting member to move in the widthwise direction of the flat wire member relative to the plate-shaped supporting member.

9. A connector assembly according to claim 7, wherein the second connector further includes means for placing the flat wire member on the plate-shaped supporting member in a state that the flat wire member is inclined downward toward its leading end with respect to the plane of the plate-shaped supporting member to prevent interference between the leading end and the first connector when the leading end portion of the flat wire member is inserted into the first connector.

10. A connector assembly according to claim 7, wherein the width of a leading end portion of the supporting member is the same or smaller than that of the leading end portion of the flat wire member such that a portion of the leading end portion of the flat wire member goes out of the plate-shaped supporting member to be engaged and positioned by the positioning member upon insertion of the leading end portion of the flat wire member into the first connector.

11. A connector assembly according to claim 10, wherein the second connector further includes means for placing the flat wire member on the flat-shaped supporting member in a state that the flat wire member is inclined downward toward its leading end with respect to the plane of the plate-shaped supporting member to prevent interference between the leading end and the first connector when the leading end portion of the flat wire member is inserted into the first connector.

12. A connector assembly according to claim 10, wherein the second connector further includes a restricting member fixedly mounted on an underside of the flat wire member, and the plate-shaped supporting member is formed with a restricting recess for receiving the restricting member to prevent the restricting member from moving, relative to the plate-shaped supporting member, in the direction of the insertion of the leading end portion of the flat wire member, while allowing the movement of the restricting member to move in the widthwise direction of the flat wire member relative to the plate-shaped supporting member.

13. A connector assembly according to claim 12, wherein the second connector further includes means for placing the flat wire member on the plate-shaped supporting member in a state that the flat wire member is inclined downward toward its leading end with respect to the plane of the plate-shaped supporting member to prevent interference between the leading end and the first connector when the leading end portion of the flat wire member is inserted into the first connector.

14. A connector assembly according to claim 13, wherein the supporting member is formed with a protecting portion extending along the leading edge of the supporting member to cover and protect the leading edge of the flat wire member.

15. A connector assembly for a flat wire member having a plurality of wirings, comprising:

a first connector including connecting terminals accommodated therein, each terminal having a contact arm, and a second connector for holding the flat wire member, the second connector including a plate-shaped supporting member for supporting a leading end portion of the flat wire member and a housing for retaining the leading end portion on the supporting member, the supporting member and the housing holding the leading end portion in such a way that the leading end portion is movable in its widthwise direction, with a portion of the leading end portion being exposed on the housing, the first and second connectors having structures to couple the connectors with each other by slidably fitting portions of the connectors one on the other, with the leading end portion of the flat wire member being inserted into the first connector to engage the contact arms, and the first connector further including a positioning member which is to engage a side of the leading end portion of the flat wire member to position the leading end portion in its widthwise direction relative to the contact arm when the leading end portion is inserted into the first connector, wherein the flat wire member is formed with a pair of protruding portions protruding from a leading edge of the leading end portion of the flat wire member at its opposite widthwise ends, the protruding portions extending in the direction in which the leading end portion is inserted into the first connector, such that the protruding portions come into contact with the positioning member before the wirings on the flat wire member is inserted in the first connector.

16. A connector assembly for a flat wire member having a plurality of wirings, comprising:

a first connector including connecting terminals accommodated therein, each terminal having a contact arm, and a second connector for holding the flat wire member, the second connector including a plate-shaped supporting member for supporting a leading end portion of the flat wire member and a housing for retaining the leading end portion on the supporting member, the supporting member and the housing holding the leading end portion in such a way that the leading end portion is movable in its widthwise direction, with a portion of the leading end portion being exposed on the housing, the first and second connectors having structures to couple the connectors with each other by slidably fitting portions of the connectors one on the other, with the leading end portion of the flat wire member being inserted into the first connector to engage the contact arms, and the first connector further including a positioning member which is to engage a side of the leading end portion of the flat wire member to position the leading end portion in its widthwise direction relative to the contact arm when the leading end portion is inserted into the first connector, wherein the width of the leading end portion of the supporting member is the same or smaller than that of the leading end portion of the flat wire member such that a portion of the leading end portion of the flat wire member goes out of the plate-shaped supporting member to be engaged and positioned by the positioning member upon insertion of the leading end portion of the flat wire member into the first connector.

17. A connector assembly for a flat wire member having a plurality of wirings, comprising:

a first connector including connecting terminals accommodated therein, each terminal having a contact arm, and a second connector for holding the flat wire member, the second connector including a plate-shaped supporting member for supporting a leading end portion of the flat wire member and a housing for retaining the leading end portion on the supporting member, the supporting member and the housing holding the leading end portion in such a way that the leading end portion is movable in its widthwise direction, with a portion of the leading end portion being exposed on the housing, the first and second connectors having structures to couple the connectors with each other by slidably fitting portions of the connectors one on the other, with the leading end portion of the flat wire member being inserted into the first connector to engage the contact arms, and the first connector further including a positioning member which is to engage a side of the leading end portion of the flat wire member to position the leading end portion in its widthwise direction relative to the contact arm when the leading end portion is inserted into the first connector, wherein the second connector further includes a restricting member fixedly mounted on an underside of the flat wire member, and the plate-shaped supporting member is formed with a restricting recess for receiving the restricting member to prevent the restricting member from moving, relative to the plate-shaped supporting member, in the direction of the insertion of the leading end portion of the flat wire member, while allowing the movement of the restricting member to move in the widthwise direction of the flat wire member relative to the plate-shaped supporting member.

18. A connector assembly for a flat wire member having a plurality of wirings, comprising:

a first connector including connecting terminals accommodated therein, each terminal having a contact arm, and a second connector for holding the flat wire member, the second connector including a plate-shaped supporting member for supporting a leading end portion of the flat wire member and a housing for retaining the leading end portion on the supporting member, the supporting member and the housing holding the leading end portion in such a way that the leading end portion is movable in its widthwise direction, with a portion of the leading end portion being exposed on the housing, the first and second connectors having structures to couple the connectors with each other by slidably fitting portions of the connectors one on the other, with the leading end portion of the flat wire member being inserted into the first connector to engage the contact arms, and the first connector further including a positioning member which is to engage a side of the leading end portion of the flat wire member to position the leading end portion in its widthwise direction relative to the contact arm when the leading end portion is inserted into the first connector, wherein the flat wire member has a first end portion and a second end portion, the first connector has a first hood portion and second hood portion, the second connector includes a first plate-shaped supporter and a second plate-shaped supporter for restrictively supporting the first and second end portions of the flat wire member, and a first housing and a second housing for respectively holding the first and second end portions of the flat wire member, and the first and second end portions of the flat wire member are respectively inserted into the first and second hood portions.

19. A connector assembly for a flat wire member having a plurality of wirings, comprising:

a first connector including connecting terminals accommodated therein, each terminal having a contact arm, and a second connector for holding the flat wire member, the second connector including a plate-shaped supporting member for supporting a leading end portion of the flat wire member and a housing for retaining the leading end portion on the supporting member, the supporting member and the housing holding the leading end portion in such a way that the leading end portion is movable in its widthwise direction, with a portion of the leading end portion being exposed on the housing, the first and second connectors having structures to couple the connectors with each other by slidably fitting portions of the connectors one on the other, with the leading end portion of the flat wire member being inserted into the first connector to engage the contact arms, and the first connector further including a positioning member which is to engage a side of the leading end portion of the flat wire member to position the leading end portion in its widthwise direction relative to the contact arm when the leading end portion is inserted into the first connector, wherein the flat wire member is formed with a pair of recesses and a plate-shaped supporter is formed with a pair of projections on the opposite sides of the supporter, the projections being respectively received by the recesses when the supporter supports the leading end portion of the flat wire member, the distance between the projections being larger than the distance between bottom sides of the recesses to allow the leading end portion of the flat wire member to move in its widthwise direction.

* * * * *